US012371244B2

(12) United States Patent
Hirose et al.

(10) Patent No.: US 12,371,244 B2
(45) Date of Patent: Jul. 29, 2025

(54) CONSTANT TEMPERATURE TRANSPORT CONTAINER, AND CONSTANT TEMPERATURE TRANSPORT CONTAINER ASSEMBLY

(71) Applicants: KANEKA CORPORATION, Osaka (JP); TAMAIKASEI CO., LTD., Hokkaido (JP)

(72) Inventors: Fuminobu Hirose, Osaka (JP); Risa Narahara, Osaka (JP); Yuka Sekiya, Hokkaido (JP); Masatada Sakai, Hokkaido (JP)

(73) Assignees: KANEKA CORPORATION, Osaka (JP); TAMAIKASEI CO., LTD., Hokkaido (JP)

( * ) Notice: Subject to any disclaimer, the term of this patent is extended or adjusted under 35 U.S.C. 154(b) by 135 days.

(21) Appl. No.: 18/232,211

(22) Filed: Aug. 9, 2023

(65) Prior Publication Data

US 2023/0382624 A1 Nov. 30, 2023

Related U.S. Application Data

(63) Continuation of application No. PCT/JP2022/003534, filed on Jan. 31, 2022.

(30) Foreign Application Priority Data

Feb. 10, 2021 (JP) ..... 2021-020098
Feb. 10, 2021 (JP) ..... 2021-020099

(51) Int. Cl.
*B65D 81/38* (2006.01)
*B65D 21/02* (2006.01)

(52) U.S. Cl.
CPC ..... *B65D 81/3813* (2013.01); *B65D 21/02* (2013.01)

(58) Field of Classification Search
CPC ..... B65D 81/3813; B65D 21/02; B65D 2571/00037; B65D 21/0204;
(Continued)

(56) References Cited

U.S. PATENT DOCUMENTS 11,499,770 B2 * 11/2022 Rizzo ..... B65D 81/3834
2014/0091098 A1 4/2014 Casoli
(Continued)

FOREIGN PATENT DOCUMENTS

EP 2 699 481 B1 11/2015
EP 3351876 A1 7/2018
(Continued)

OTHER PUBLICATIONS

International Search Report issued in corresponding International Application No. PCT/JP2022/003534, dated Mar. 1, 2022 (4 pages).
(Continued)

*Primary Examiner* — Andrew D Perreault
(74) *Attorney, Agent, or Firm* — Osha Bergman Watanabe & Burton LLP

(57) ABSTRACT

To simply carry out packing in a constant-temperature transport package, a constant-temperature transport container includes a housing part that is provided on an outer side of a heat insulating container. The housing part is for housing a heat storage material in at least one surface selected from the group consisting of short-side surface parts, long-side surface parts, and a bottom surface part.

13 Claims, 20 Drawing Sheets

(58) Field of Classification Search
CPC ..... B65D 21/0209; B65D 21/023; B65D 71/0096; B65D 81/3816; B65D 81/3823; F25D 2303/08; F25D 2303/08221; F25D 3/06; F25D 11/006
See application file for complete search history.

(56) References Cited

U.S. PATENT DOCUMENTS

| | | | | |
|---|---|---|---|---|
| 2019/0145688 | A1* | 5/2019 | Tsuno ..... | B65D 81/20 62/129 |
| 2019/0226744 | A1 | 7/2019 | Wood et al. | |

FOREIGN PATENT DOCUMENTS

| | | | |
|---|---|---|---|
| EP | 3191379 | B1 | 3/2019 |
| EP | 2925630 | B1 | 11/2020 |
| JP | 2000159271 | A | 6/2000 |
| JP | 2014-185827 | A | 10/2014 |
| JP | 2015-009838 | A | 1/2015 |
| JP | 2019-131278 | A | 8/2019 |
| JP | 2019-163079 | A | 9/2019 |
| KR | 20140004456 | A | 1/2014 |
| WO | 2014/125878 | A1 | 8/2014 |

OTHER PUBLICATIONS

International Preliminary Report on Patentability issued in corresponding International Application No. PCT/JP2022/003534, dated Aug. 15, 2023 (7 pages).
Extended European Search Report issued in corresponding European Patent Application No. 22752625.8, dated Feb. 13, 2025 (11 pages).

* cited by examiner

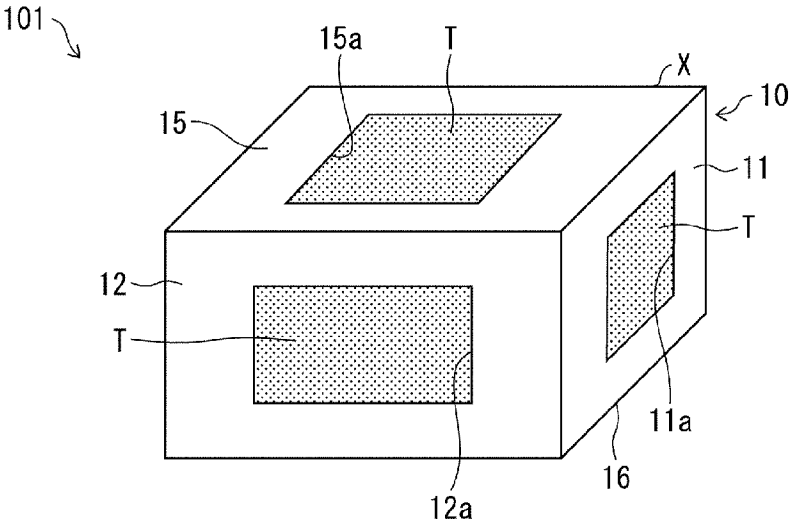
FIG. 1A
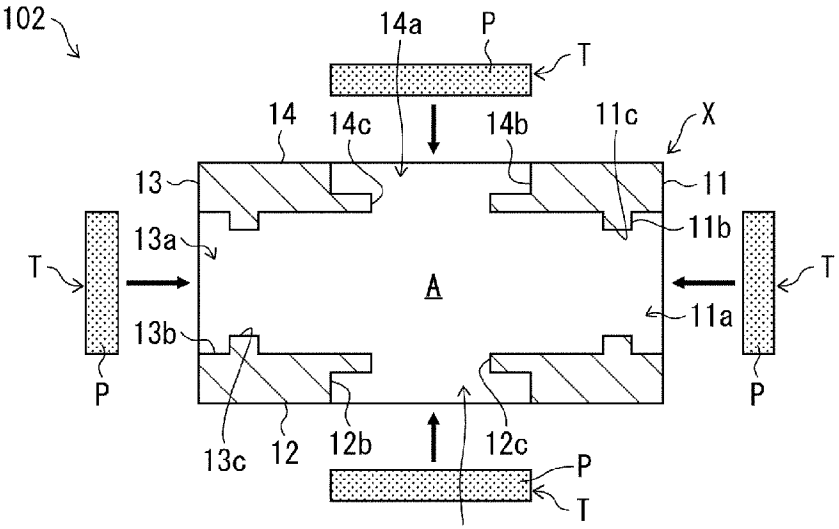
FIG. 1B
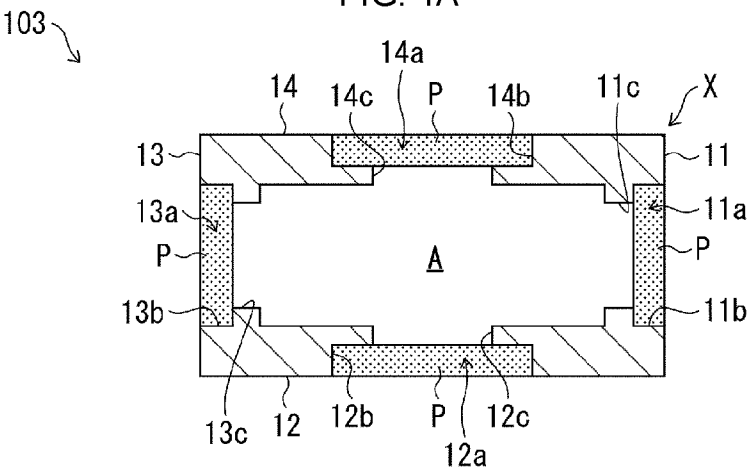
FIG. 1C
FIG. 1D

CONSTANT TEMPERATURE TRANSPORT CONTAINER, AND CONSTANT TEMPERATURE TRANSPORT CONTAINER ASSEMBLY

TECHNICAL FIELD

One or more embodiments of the present invention relate to a constant-temperature transport container and a constant-temperature transport container assembly.

BACKGROUND

A method of transporting or storing articles such as pharmaceutical products, medical devices, cells, specimens, organs, chemical substances, foods, and the like in a state in which the articles are kept cooled or warm may be, for example, as follows. That is, a cold storage material or a heat storage material having been frozen or solidified in advance is placed in a container having a heat insulating property, so as to prepare a heat-insulated transporting container. Then, by using melting latent heat of the cold storage material or solidification latent heat of the heat storage material, an article housed in the heat-insulated transporting container is transported or stored with the temperature of the article maintained. Further, in this method, a cold storage material or a heat storage material having been melted in advance can also be used. To maintain the above-described article to be kept warm (hereinafter, which may also be referred to as a "temperature-keeping target article") within a given temperature (hereinafter, which may also be referred to as a "controlled temperature") range for a long time, it is considered preferable to use a constant-temperature transport container including (i) a cold storage material having a melting temperature in the given temperature range or a heat storage material having a melting temperature in the given temperature range and (ii) a container having a heat insulating property. Typically, a temperature-keeping target article is transported in the form of a constant-temperature transport package including a constant-temperature transport container in which the temperature-keeping target article is packed.

For example, Patent Literature 1 discloses a constant-temperature transport container that can be assembled by fitting four side wall panels, a bottom panel, and a ceiling panel to each other. Further, Patent Literature 2 discloses a constant-temperature transport container configured such that heat storage materials can be inserted thereinto from lateral sides of side wall panels.

PATENT LITERATURES

[Patent Literature 1]
International Publication No. WO 2014/125878
[Patent Literature 2]
Specification of European Patent No. 2699481

However, the constant-temperature transport containers described in Patent Literatures 1 and 2 still have room for improvement in terms of ease of packing of the heat storage material into the heat insulating container.

SUMMARY

An aspect of one or more embodiments of the present invention is to provide a constant-temperature transport container capable of easily packing a heat storage material into a heat insulating container.

In order to solve the above, a constant-temperature transport container in accordance with an aspect of one or more embodiments of the present invention is a constant-temperature transport container including: a heat insulating container; and a heat storage material, the heat insulating container having a luggage formed therein and being in a shape of a cuboid box, the heat insulating container having side surface parts, a top surface part, and a bottom surface part, the constant-temperature transport container including a housing part that is provided on an outer side of the heat insulating container and that is for housing the heat storage material in at least one surface selected from the group consisting of the side surface parts and the bottom surface part.

According to an aspect of one or more embodiments of the present invention, it is possible to easily pack a heat storage material into a heat insulating container.

BRIEF DESCRIPTION OF THE DRAWINGS

101 of FIG. 1A is a perspective view schematically illustrating a configuration of a constant-temperature transport container in accordance with Embodiment 1 of one or more embodiments of the present invention, 102 and 103 of FIGS. 1B-C are plan views each schematically illustrating the configuration of the constant-temperature transport container in accordance with Embodiment 1 of one or more embodiments of the present invention, and 104 of FIG. 1D is a plan view schematically illustrating the configuration of a constant-temperature transport container in accordance with Variation 1.

201 to 209 of FIGS. 2A-I are side views each illustrating an example of a stored material to be housed in a housing part of the constant-temperature transport container in accordance with Embodiment 1 of one or more embodiments of the present invention.

Figure 6A:
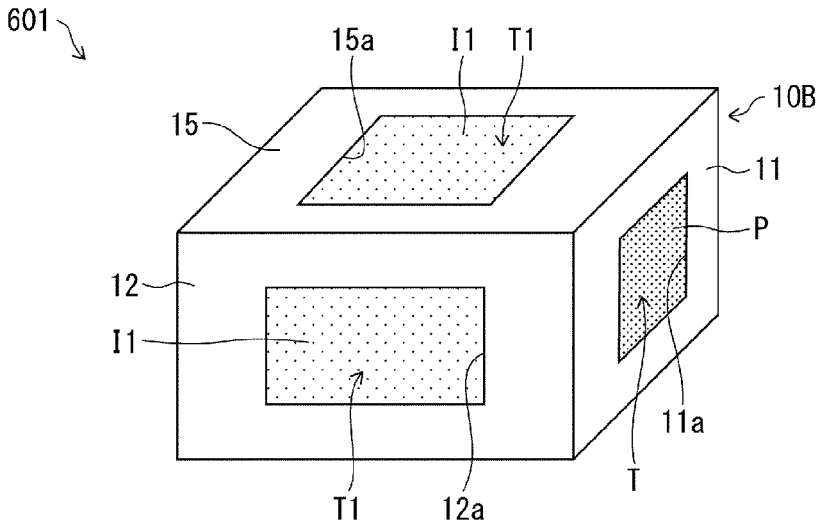
Figure 6B:
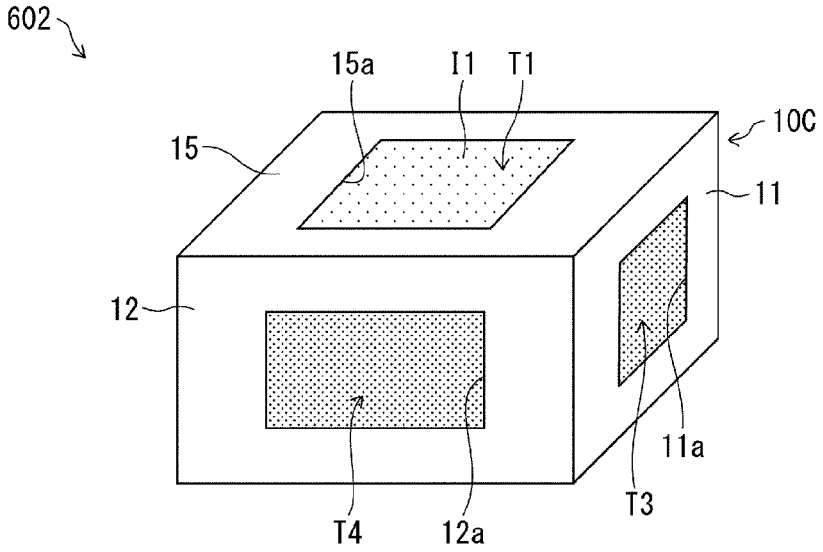

601 and 602 of FIGS. 6A-B are perspective views illustrating configurations of Variations 2 and 3 of the constant-temperature transport containers in accordance with Embodiment 1 of one or more embodiments of the present invention.

Figure 7:
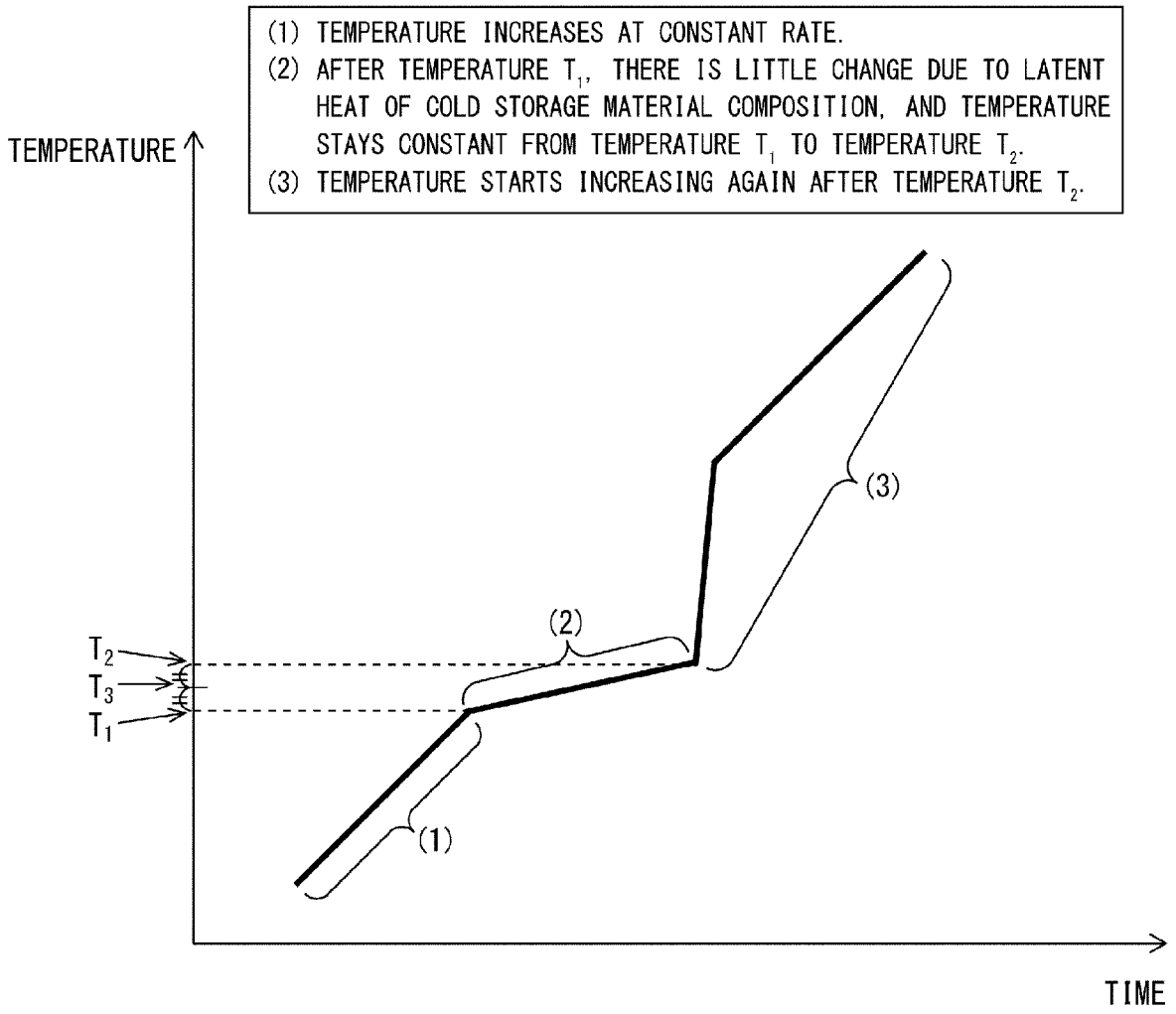

FIG. 7 is a graph plotting a change over time in temperature of a cold storage material composition when a cold storage material composition in a solidified state was placed in a thermostatic bath and the temperature of the thermostatic bath was then increased from a cryogenic temperature at a constant rate of temperature increase.

Figure 8:
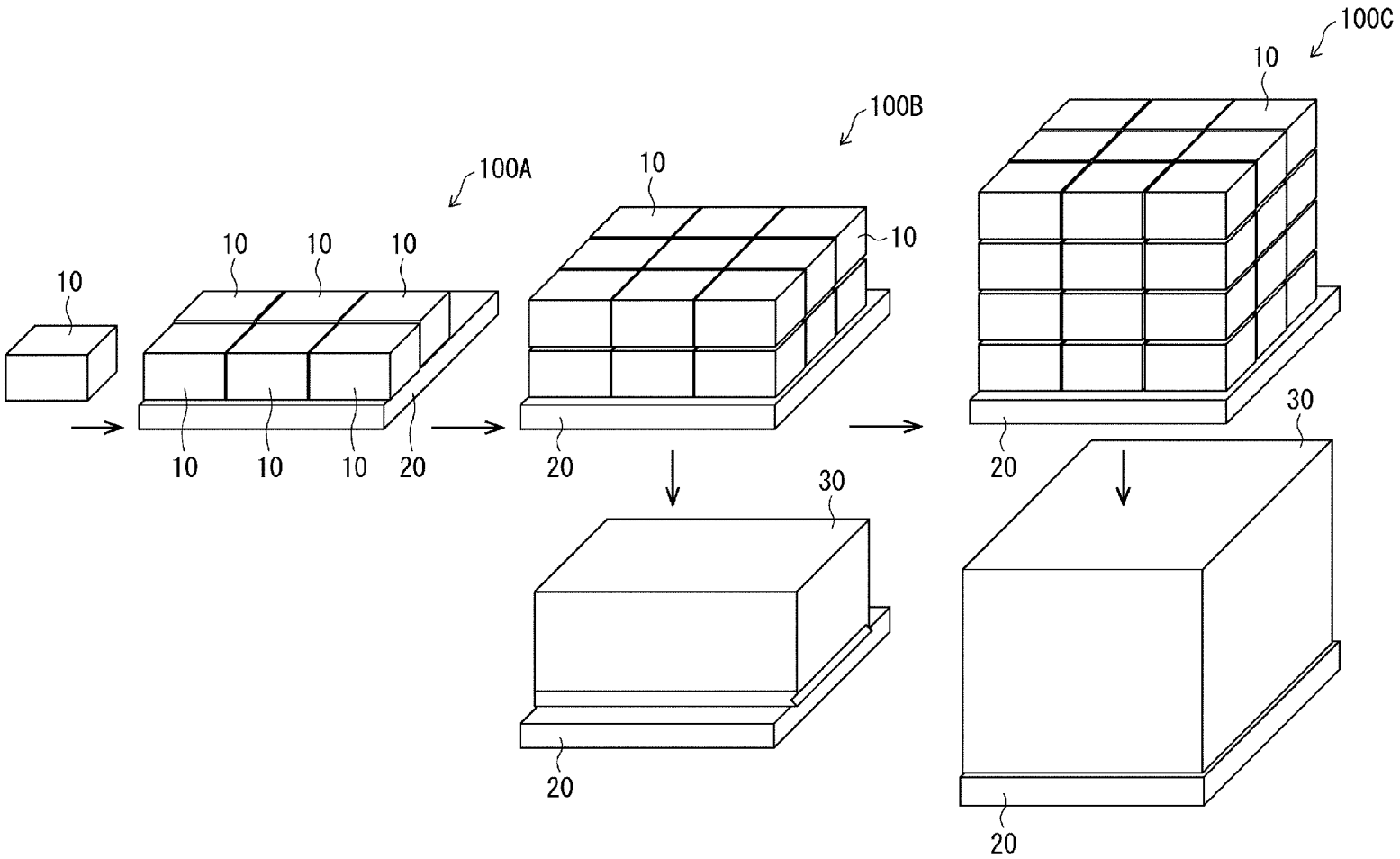

FIG. 8 is a diagram schematically illustrating a configuration example of a constant-temperature transport container assembly in accordance with Embodiment 1 of one or more embodiments of the present invention.

Figure 9A:
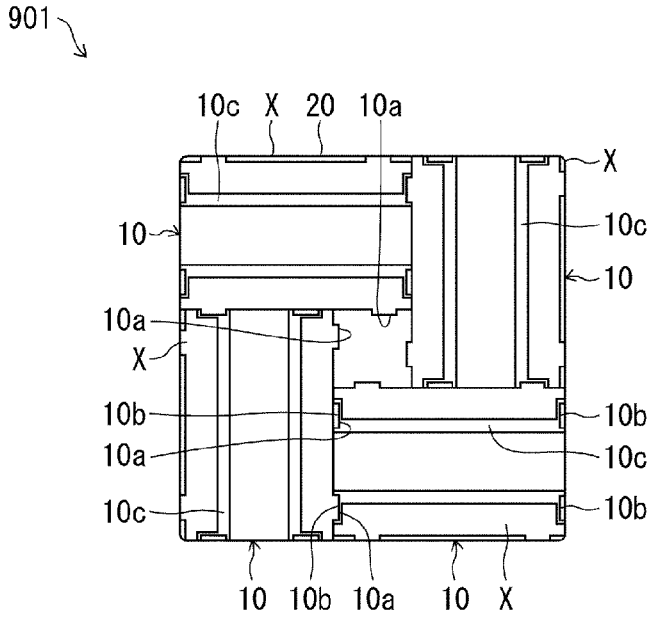
Figure 9B:
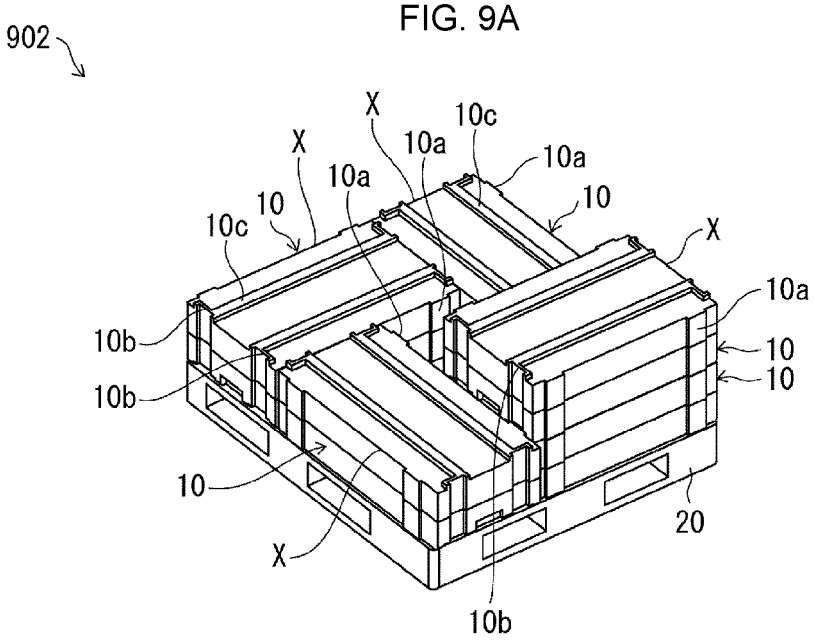

FIGS. 9A-B illustrate an example of a fitting structure between the constant-temperature transport containers in accordance with Embodiment 1 of one or more embodiments of the present invention, 901 of FIG. 9A is a plan view, and 902 of FIG. 9B is a perspective view.

Figure 10A:
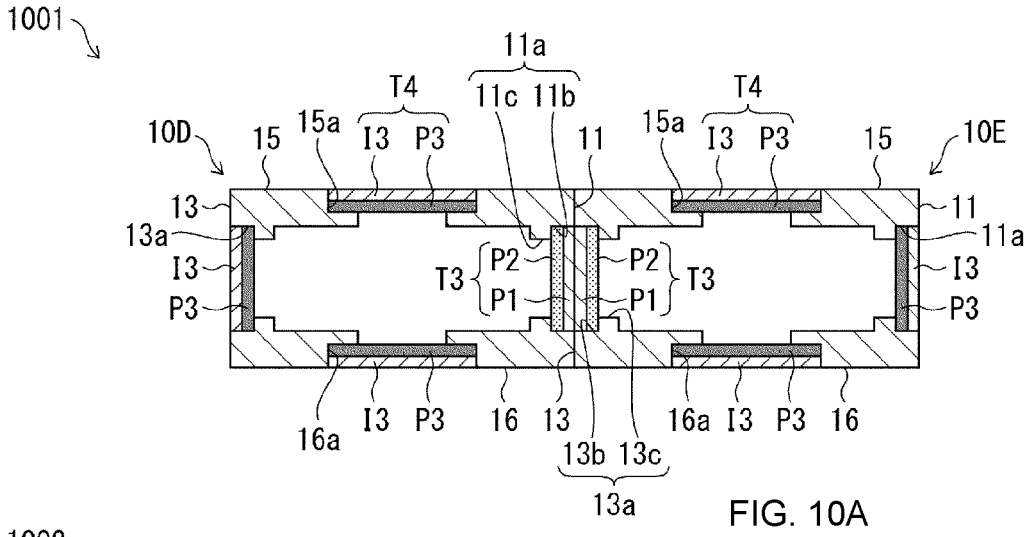
Figure 10B:
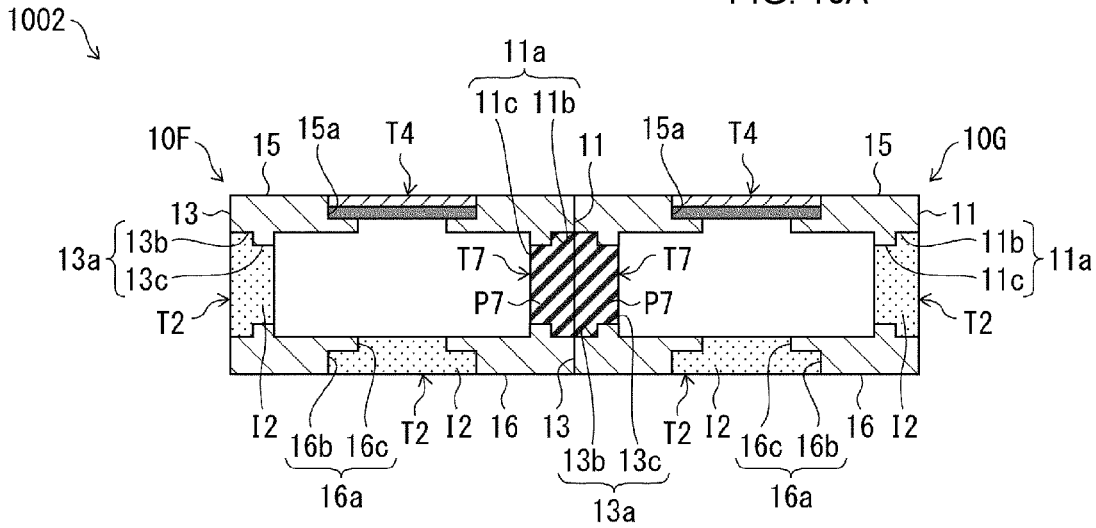
Figure 10C:
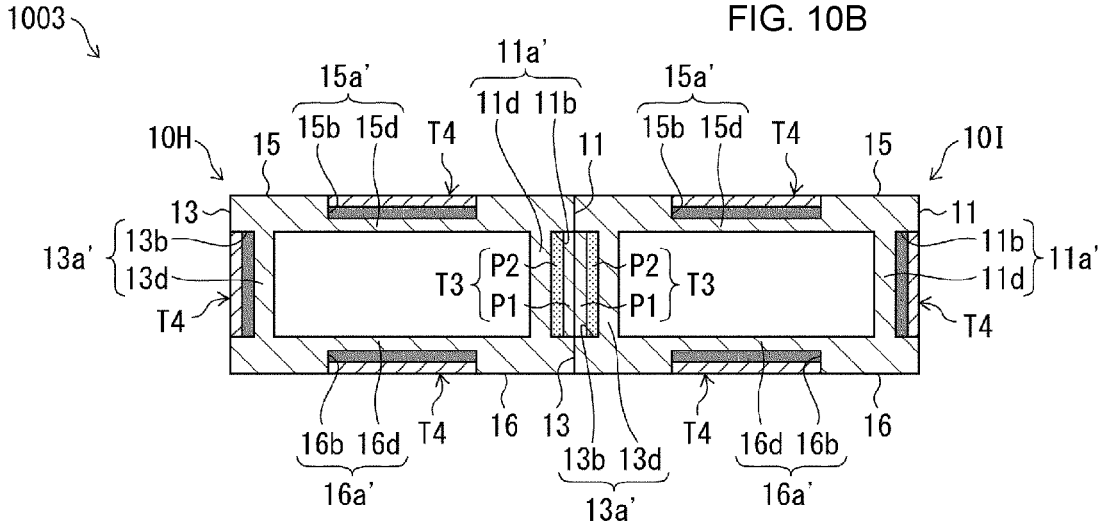

1001 to 1003 of FIGS. 10A-C are cross-sectional views each illustrating a specific example of a constituent unit having two constant-temperature transport containers applicable to the constant-temperature transport container assembly in accordance with Embodiment 1 of one or more embodiments of the present invention.

Figure 11A:
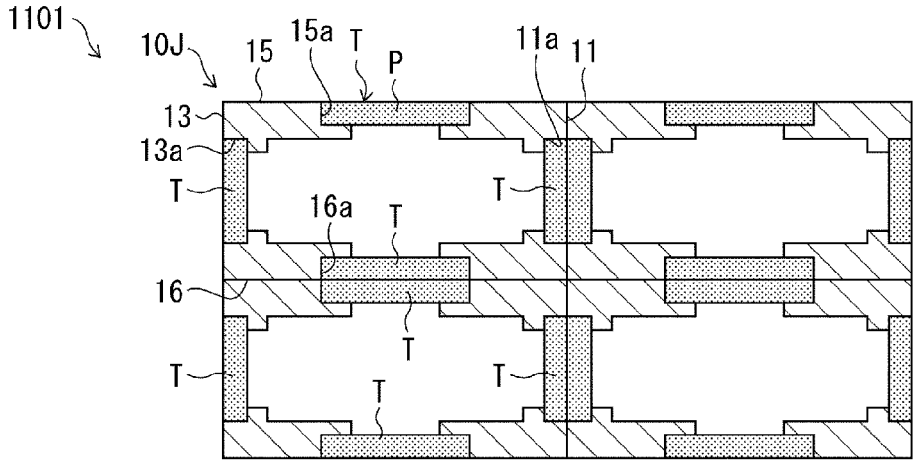
Figure 11B:
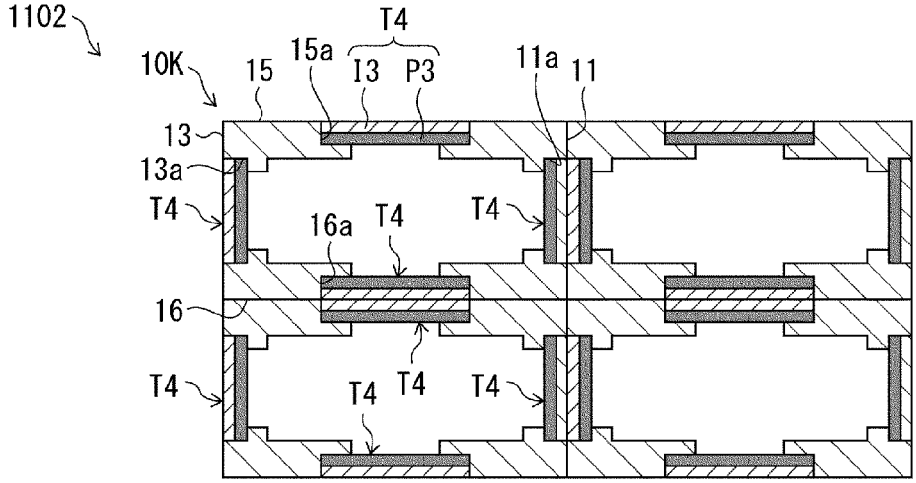
Figure 11C:
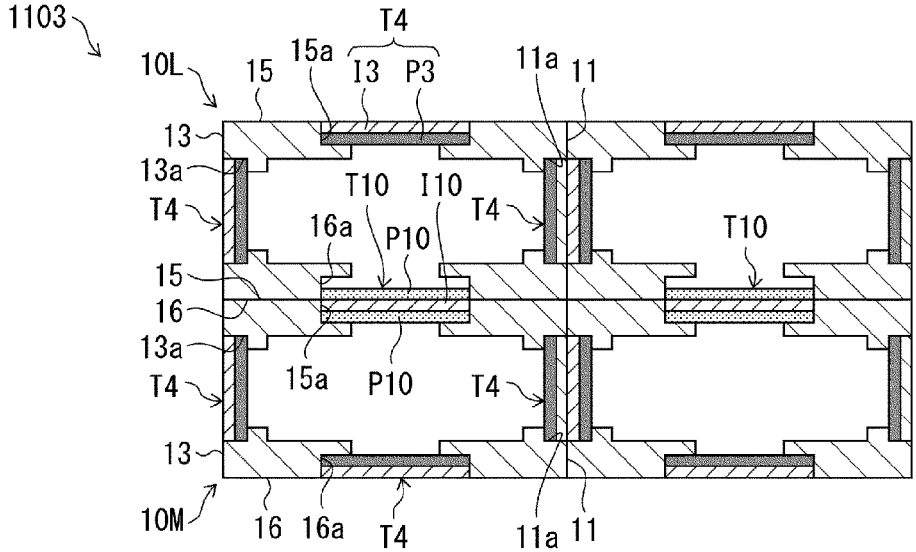

1101 to 1103 of FIGS. 11A-C are cross-sectional views each illustrating a specific example of a constituent unit having four constant-temperature transport containers applicable to the constant-temperature transport container assembly in accordance with Embodiment 1 of one or more embodiments of the present invention.

Figure 12:
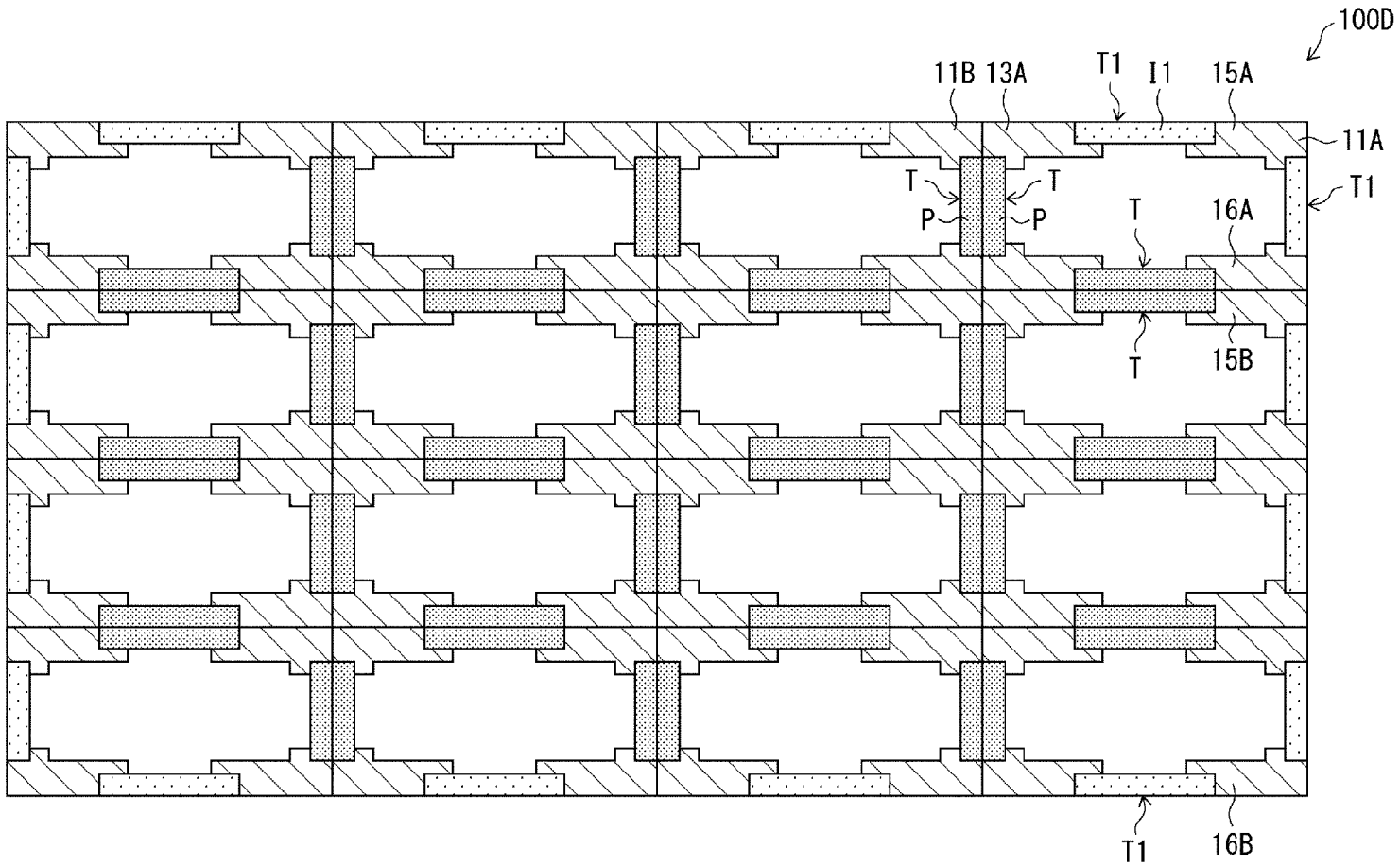

FIG. 12 is a cross-sectional view illustrating an example of a constant-temperature transport container assembly in which four by four-stage constant-temperature transport containers are loaded.

Figure 13:
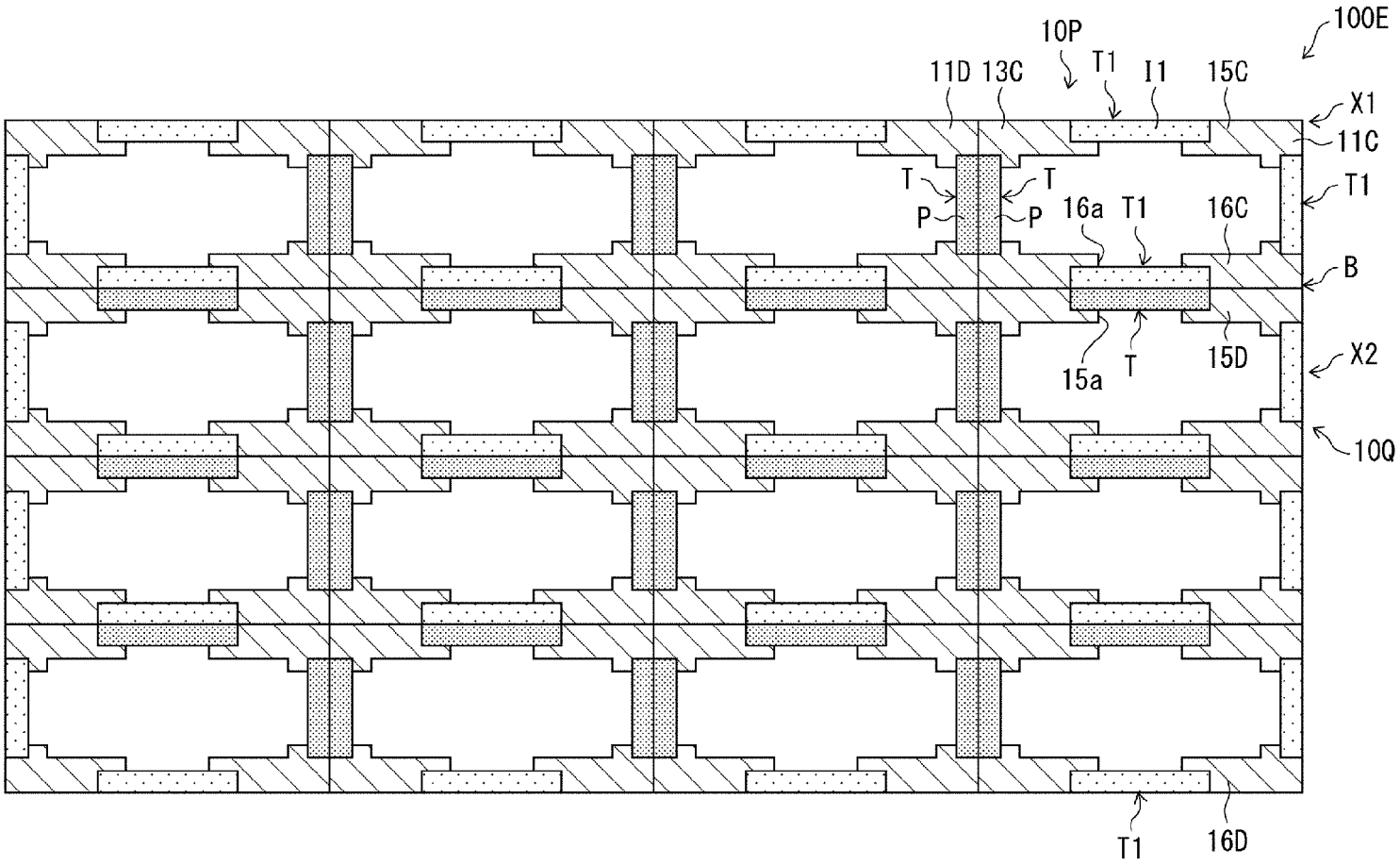

FIG. 13 is a cross-sectional view illustrating an example of a constant-temperature transport container assembly in which four by four-stage constant-temperature transport containers are loaded.

Figure 14:
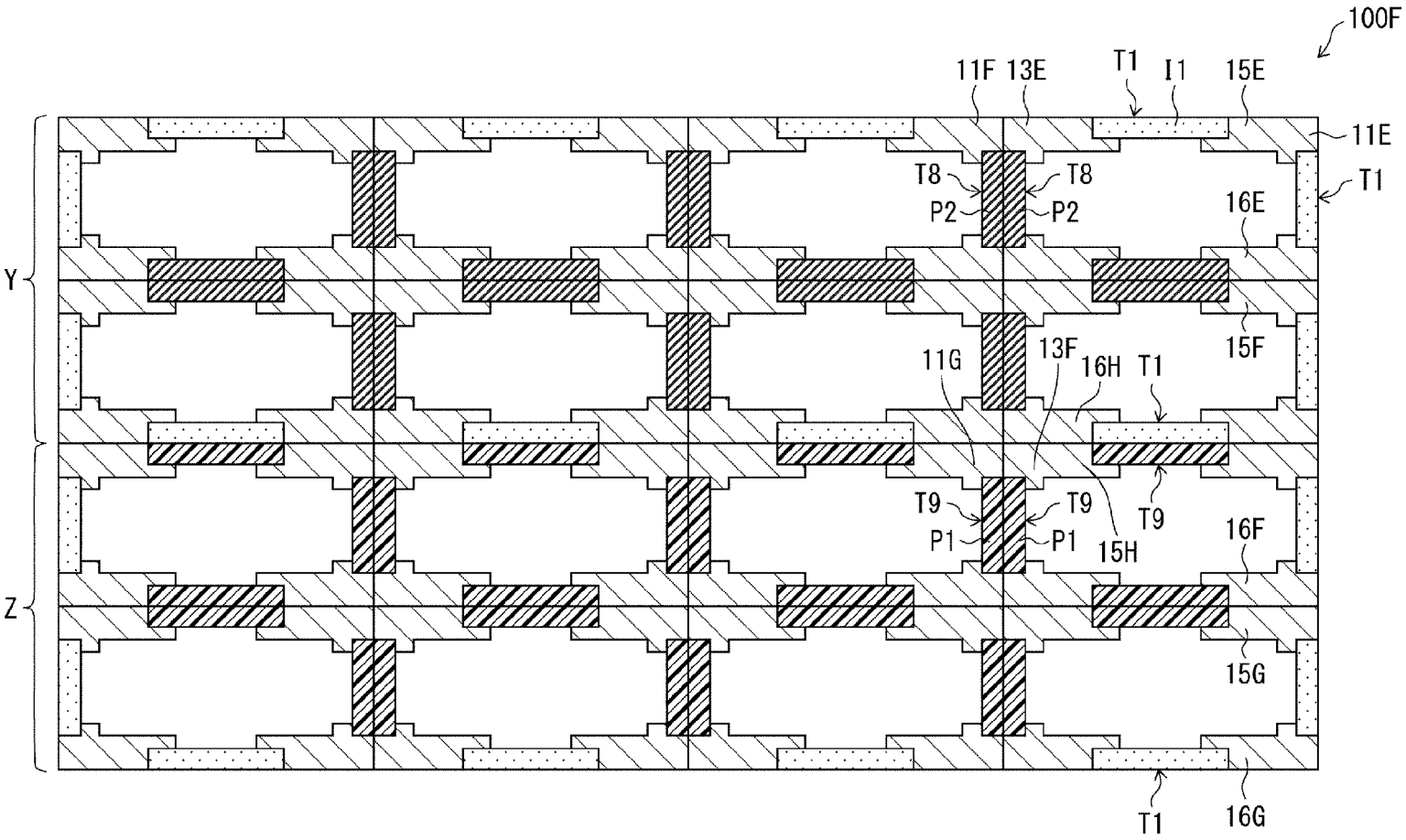

FIG. 14 is a cross-sectional view illustrating an example of a constant-temperature transport container assembly in which four by four-stage constant-temperature transport containers are loaded.

Figure 15:
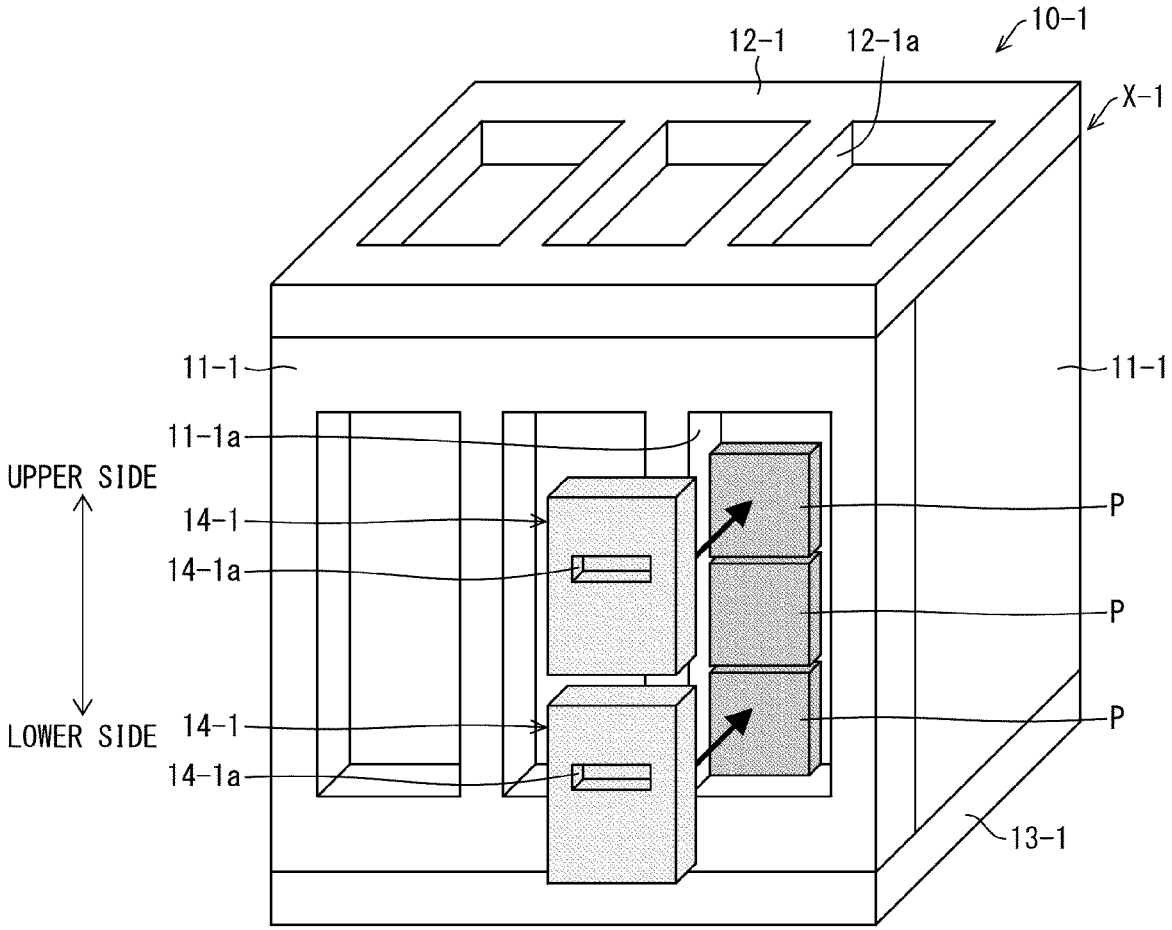

FIG. 15 is a perspective view schematically illustrating a configuration of a constant-temperature transport container in accordance with Embodiment 2 of one or more embodiments of the present invention.

Figure 16A:
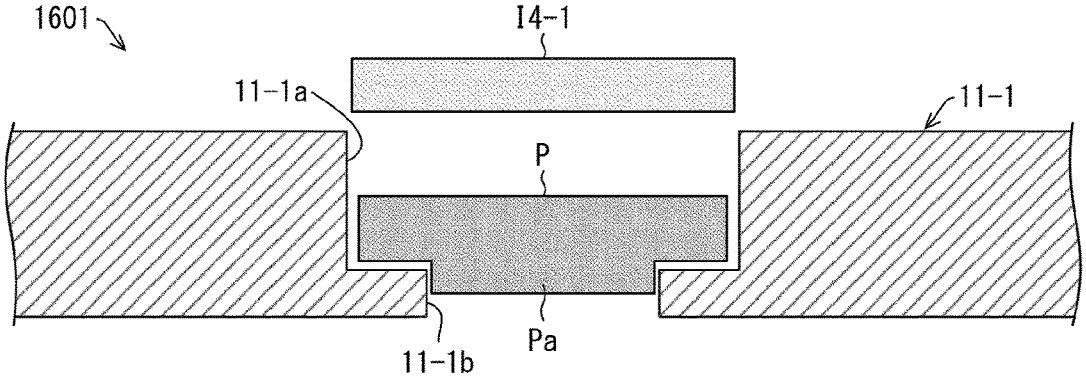
Figure 16B:
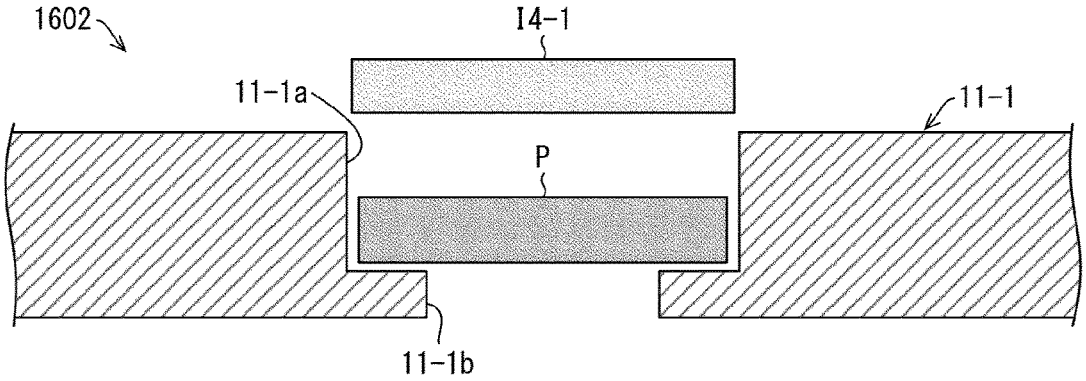

1601 and 1602 of FIGS. 16A-B are cross-sectional views each illustrating an example of a configuration of a side wall panel included in the constant-temperature transport container in accordance with Embodiment 2 of one or more embodiments of the present invention.

Figure 17:
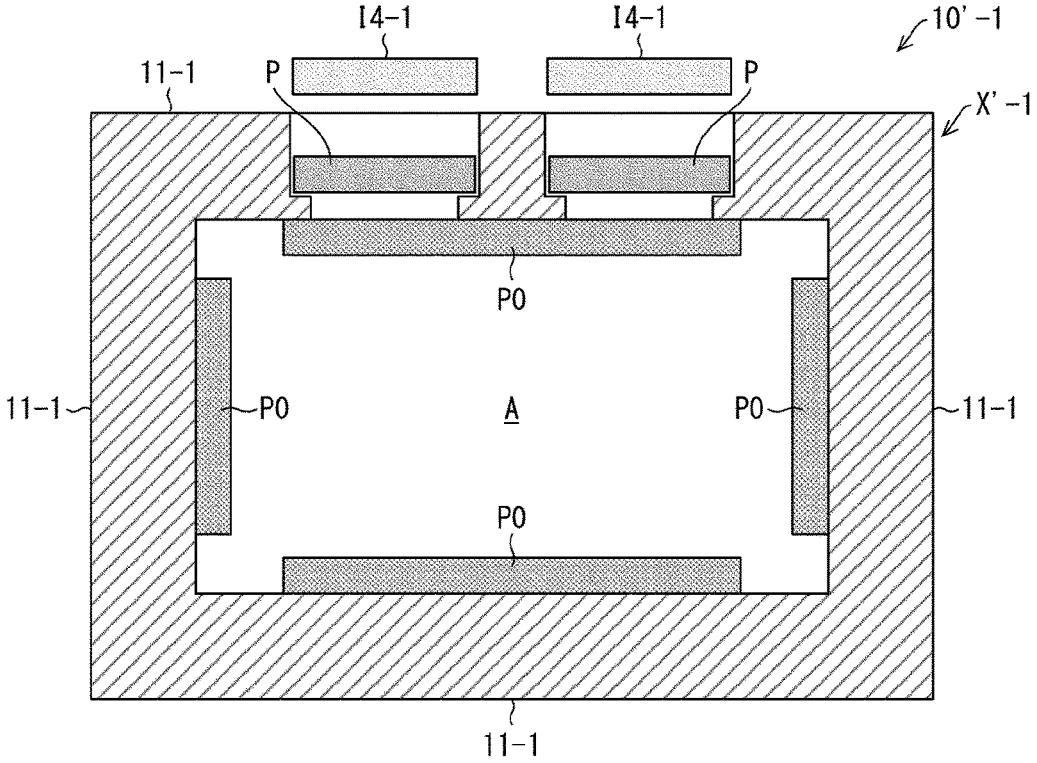

FIG. 17 is a plan view schematically illustrating a configuration of Variation 1 of the constant-temperature transport container in accordance with Embodiment 2 of one or more embodiments of the present invention.

Figure 18:
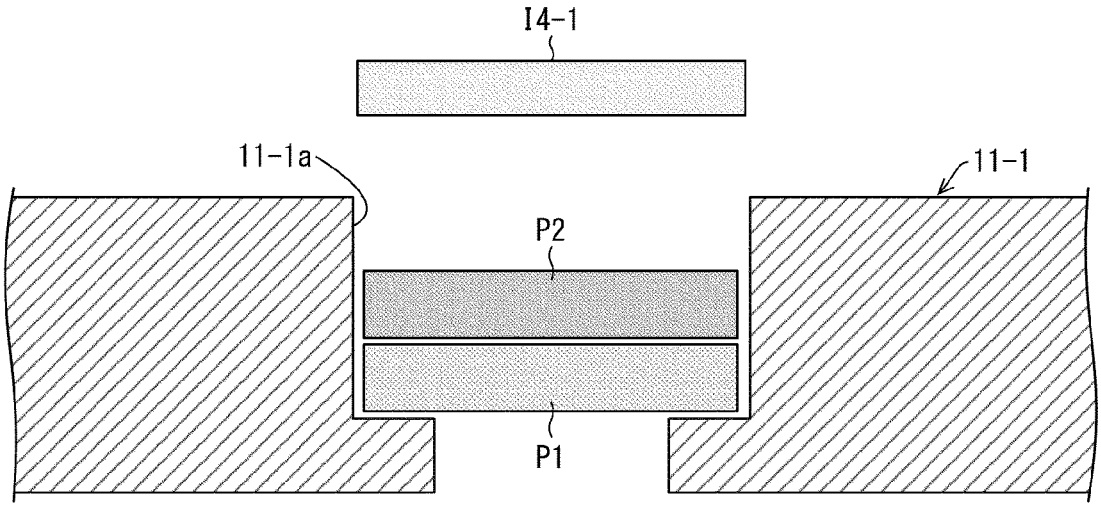

FIG. 18 is a view illustrating a configuration of a side wall panel of a constant-temperature transport container in a case where two or more kinds of heat storage material(s) and/or cold storage material(s) having different solidified/melted states are used.

Figure 19:
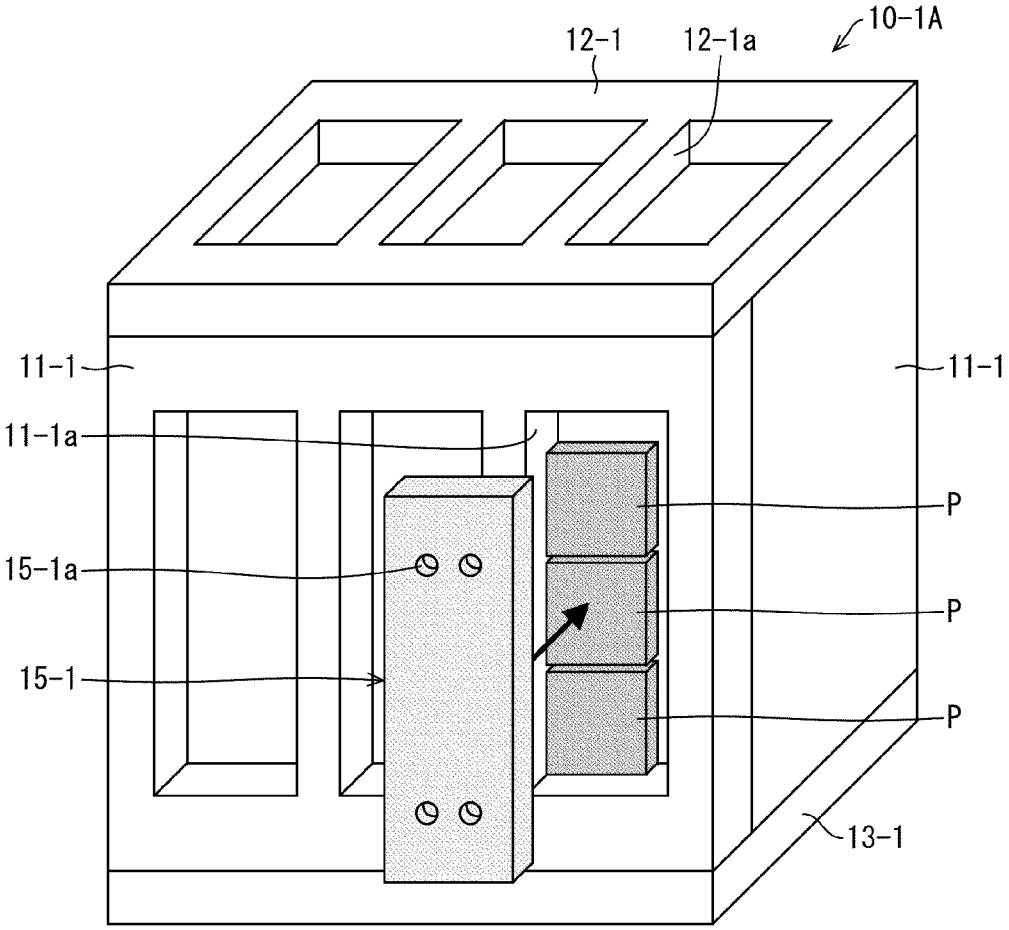

FIG. 19 is a perspective view schematically illustrating a configuration of a constant-temperature transport container in accordance with Embodiment 3 of one or more embodiments of the present invention.

Figure 20:
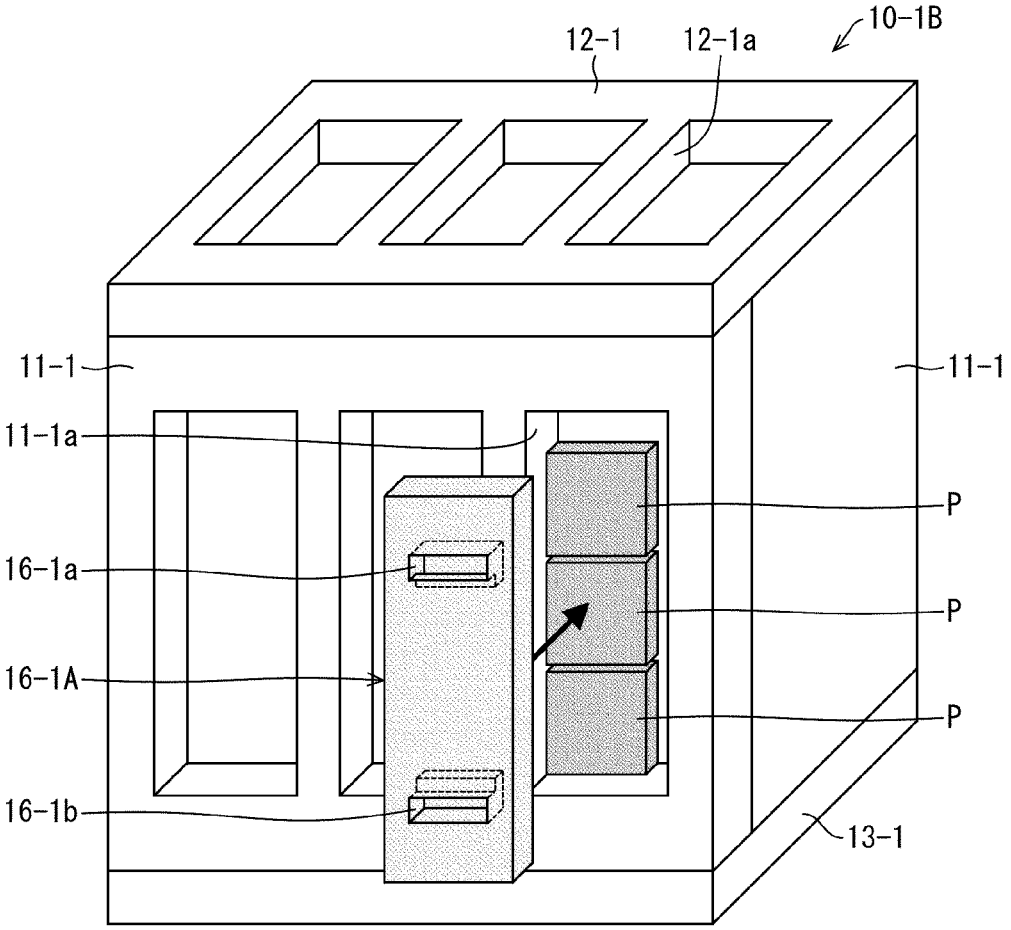

FIG. 20 is a perspective view schematically illustrating a configuration of a constant-temperature transport container in accordance with Embodiment 4 of one or more embodiments of the present invention.

Figure 21A:
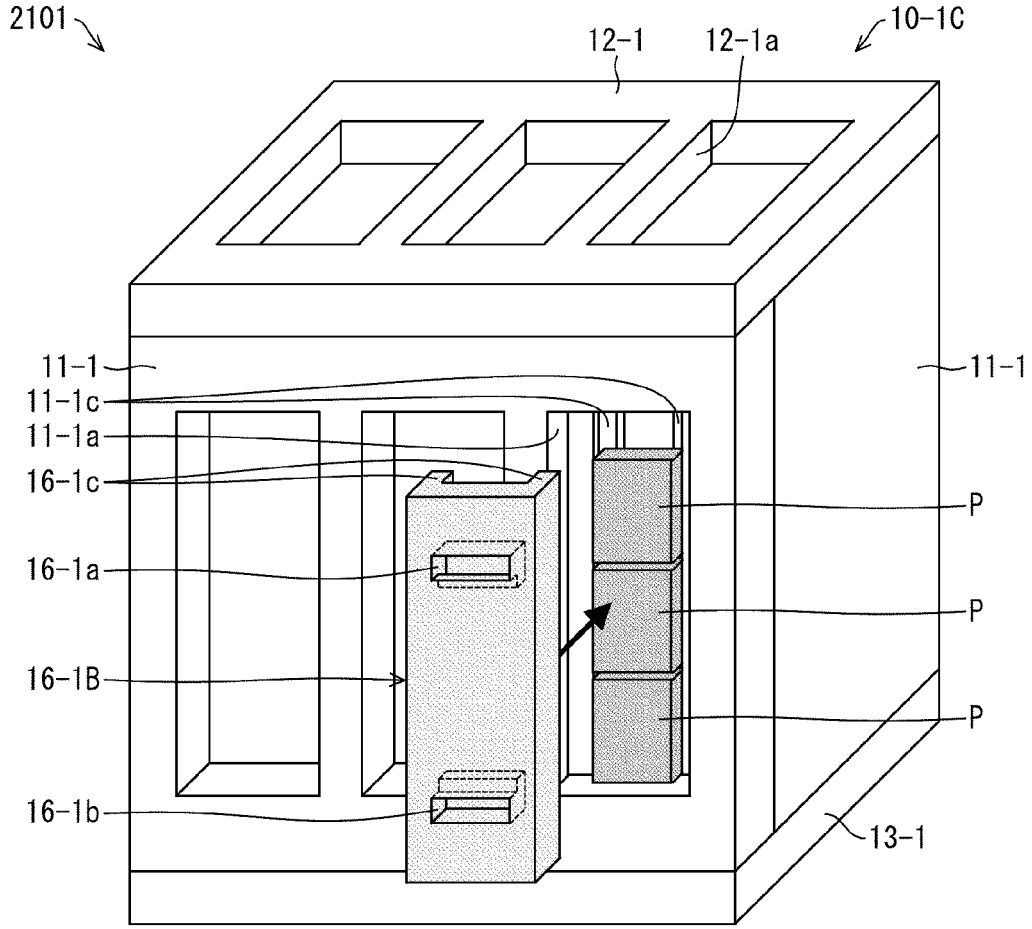
Figure 21B:
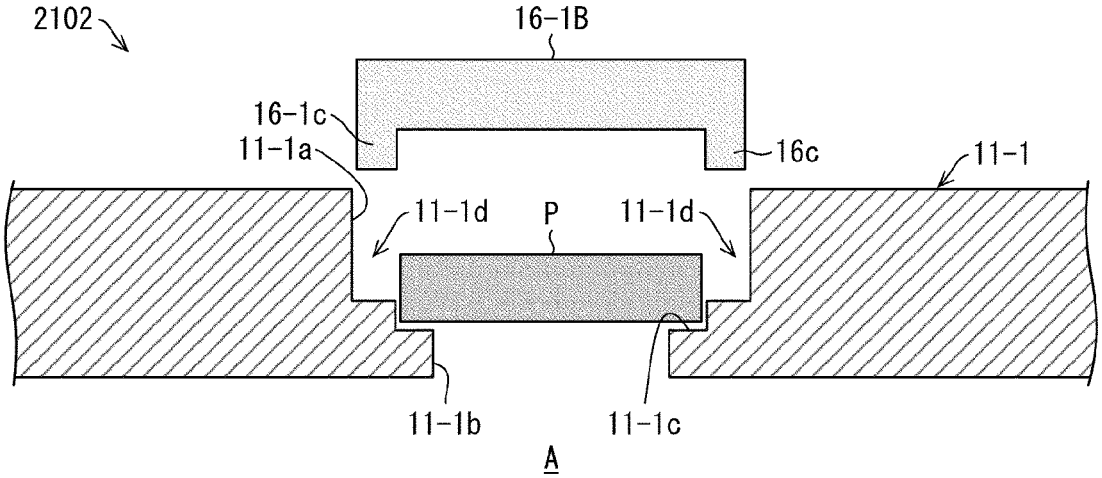

2101 of FIG. 21A is a perspective view schematically illustrating a configuration of a constant-temperature transport container in accordance with Embodiment 5 of one or more embodiments of the present invention, and 2102 of FIG. 21B is a cross-sectional view illustrating a configuration of a side wall panel of the constant-temperature transport container in accordance with Embodiment 5 of one or more embodiments of the present invention.

Figure 22:
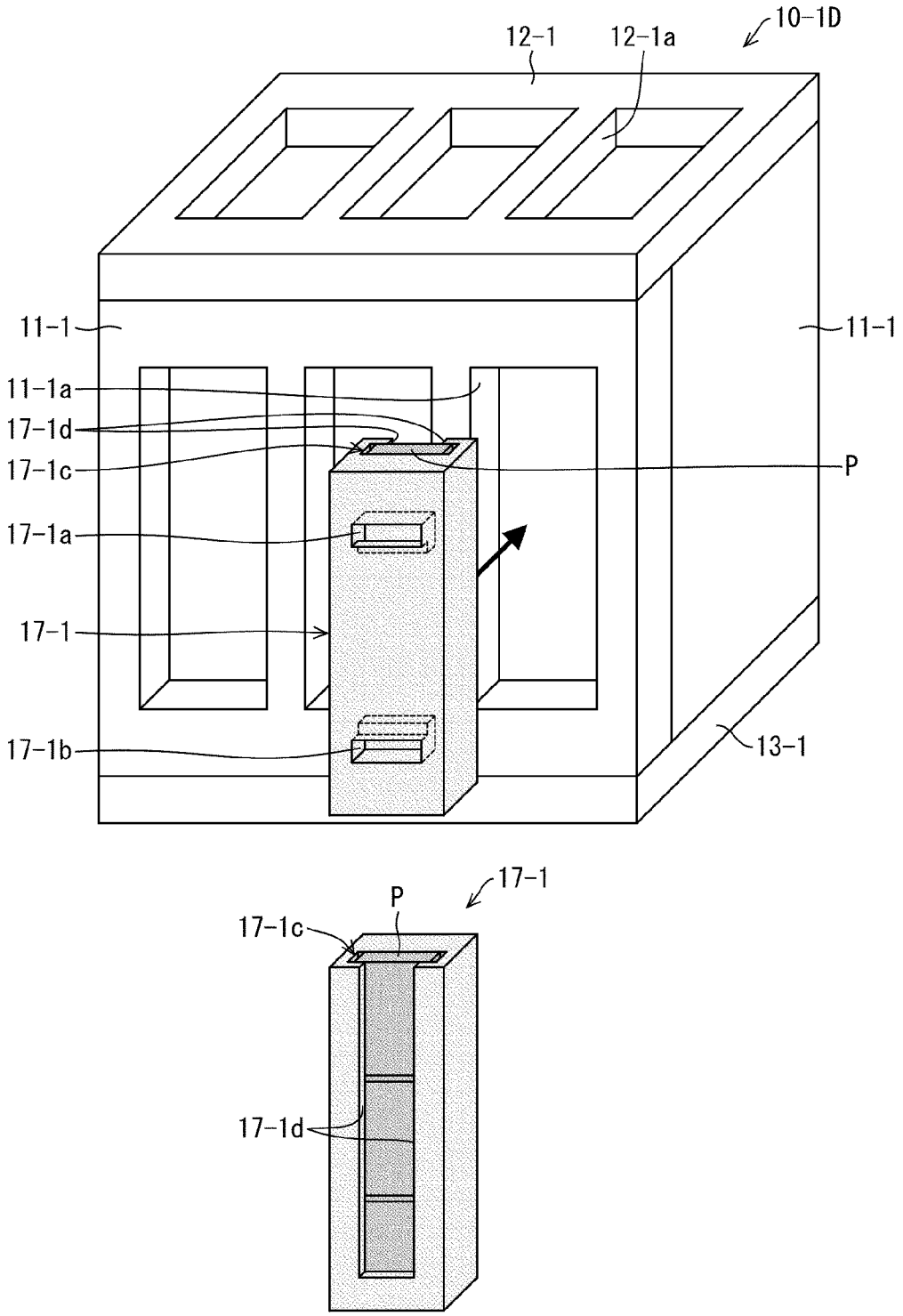

FIG. 22 is a perspective view schematically illustrating a configuration of a constant-temperature transport container in accordance with Embodiment 6 of one or more embodiments of the present invention.

Figure 23:
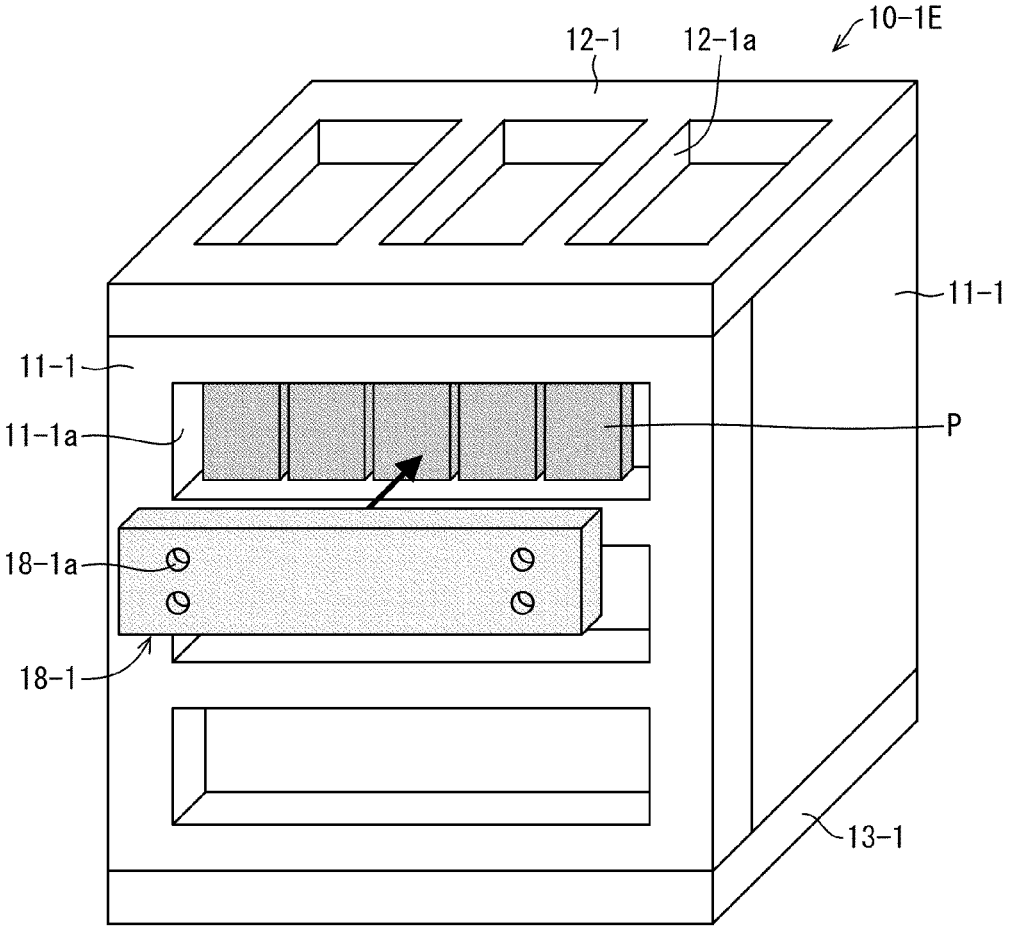

FIG. 23 is a perspective view schematically illustrating a configuration of a constant-temperature transport container in accordance with Embodiment 7 of one or more embodiments of the present invention.

DETAILED DESCRIPTION OF THE EMBODIMENTS

Technical Idea of One or More Embodiments of the Present Invention

The constant-temperature transport container described in Patent Literature 1 or 2 is produced by mounting heat storage materials in the individual wall panels and then assembling the wall panels. That is, the constant-temperature transport container described in Patent Literature 1 or 2 is configured such that the heat storage materials cannot be mounted in the state of the heat insulating container obtained by assembling the wall panels only. Therefore, it is difficult to pack the heat storage materials in the state of the heat insulating container.

The inventors of one or more embodiments of the present invention have intensively studied simplifying packing of a heat storage material into a heat insulating container. As a result, the inventors of one or more embodiments of the present invention have accomplished a constant-temperature transport container of one or more embodiments by conceiving that the configuration which allows a user to pack a heat storage material from an outer wall surface side of a heat insulating container of a constant-temperature transport container greatly reduces the time and effort required for packing the heat storage material into the heat insulating container.

Here, the constant-temperature transport container may be used (1) in the form of an assembly in which a plurality of constant-temperature transport containers are laterally connected to each other or are loaded in a height direction or (2) in the form of a single constant-temperature transport container without connecting or loading a plurality of constant-temperature transport containers. The above-described "simplification of packing of the heat storage material into the heat insulating container" is possible for both the forms (1) and (2).

Various embodiments will be described below. The constant-temperature transport container in accordance with Embodiment 1 is mainly configured to be suitable for use (1) in the form of an assembly, and the constant-temperature transport containers in accordance with Embodiments 2 to 7 are mainly configured to be suitable for use (2) in the form of a single constant-temperature transport container.

Embodiment 1

In the use (1) in the form of the assembly, the constant-temperature transport containers disclosed in Patent Literatures 1 and 2 have room for improvement in workability of setting the heat storage material with respect to each of side surface parts and a bottom surface part.

A constant-temperature transport container and a constant-temperature transport container assembly in accordance with Embodiment 1 bring about, in addition to the effect of making it possible to easily carry out packing in a constant-temperature transport package, the effect of, when used in the form of an assembly of constant-temperature transport containers, making it possible to improve workability of setting a heat storage material with respect to each of the side surface parts and the bottom surface part.

(Configuration of Constant-Temperature Transport Container 10)

The following will describe one or more embodiments of the present invention in detail. 101 of FIG. 1A is a perspective view schematically illustrating a configuration of a constant-temperature transport container 10 in accordance with one or more embodiments. 102 and 103 of FIGS. 1B-C are plan views each schematically illustrating a configuration of the constant-temperature transport container 10.

As illustrated in 101 to 103 of FIGS. 1A-C, the constant-temperature transport container 10 in accordance with one or more embodiments includes a heat insulating container X and a stored material T (fitting member). The heat insulating container X includes a container body having a luggage A formed therein, having a rectangular shape in plan view, and being made of foamed plastic. The container body has short-side surface parts 11 and 13, long-side surface parts 12 and 14, a top surface part 15, and a bottom surface part 16. The stored material T is a heat storage material P. In the specification of the present application, in the container body of the heat insulating container X, regarding each of the short-side surface parts 11 and 13, the long-side surface parts 12 and 14, the top surface part 15, and the bottom surface part 16, a luggage A side is referred to as an inner side, and a side opposite to the luggage A is referred to as an outer side.

The constant-temperature transport container 10 in accordance with one or more embodiments includes a housing part that is provided on the outer side of the container body and that is for housing the stored material T in at least one surface selected from the group consisting of the short-side surface parts 11 and 13, the long-side surface parts 12 and 14, and the bottom surface part 16. More specifically, housing parts 11*a* and 13*a* for housing the stored material T are provided on the outer sides of the short-side surface parts 11 and 13, respectively. In addition, housing parts 12*a* and 14*a* for housing the stored material T are provided on the outer sides of the long-side surface parts 12 and 14, respectively. Furthermore, the constant-temperature transport container is configured to further include a housing part 15*a* that is provided on the outer side of the container body and that is for housing the stored material T in the top surface part 15.

Note that, although not illustrated, a housing part for housing the stored material T is also provided on the outer side of the bottom surface part 16. Since the housing part is configured in the same manner as the housing parts 11*a* to a description thereof will be omitted. Further, since the housing part 15*a* provided in the top surface part 15 is also the same as the housing parts 11*a* to 14*a*, the description of the housing part 15*a* will be omitted in the following description.

As illustrated in 102 and 103 of FIGS. 1B-C, the housing parts 11*a* to 14*a* have recesses 11*b* to 14*b* that are fitted to a luggage A-side shape of the stored material T which is one heat storage material P. More specifically, each of the recesses 11*b* to 14*b* has an outer opening through which the stored material T is to be inserted from outside. Each of the recesses 11*b* to 14*b* has a shape that is fitted to the luggage A-side shape of the stored material T from the outer opening toward the inner side. In each of the housing parts 11*a* to 14*a*, the stored material T is fitted so as to be flush with at least an outer surface of each of the short-side surface parts 11 and 13 and the long-side surface parts 12 and 14.

Further, inner openings 11*c* to 14*c* are formed on respective inner sides of the recesses 11*b* to 14*b*. Each of the inner openings 11*c* to 14*c* is an opening through which each of the recesses 11*b* to 14*b* communicates with the luggage A. The opening size of each of the inner openings 11*c* to 14*c* is smaller than the size of the outer opening of each of the recesses 11*b* to 14. Such a configuration locks inward movement, from each of the inner openings 11*c* to 14*c*, of the stored material T to be inserted from outside into each of the recesses 11*b* to 14*b*. Since the inner openings 11*c* to 14*c* are provided in this manner, the stored material T housed in each of the housing parts 11*a* to 14*a*, that is, the heat storage material P, is configured to be exposed in the luggage A. Therefore, the temperature-keeping property in the luggage A is improved.

Next, a method of assembling the constant-temperature transport container 10 in which the temperature-keeping target article is housed in the luggage A will be described. In this method, first, the heat insulating container X is prepared. The heat insulating container X only need be one that is produced by a known method. For example, the heat insulating container X may be one produced in advance in a box shape as described in Japanese Patent Application Publication Tokukai No. 2019-131278 (hereinafter may be referred to as an integral type). Alternatively, the heat insulating container X may be one produced by assembling wall panels as described in Japanese Patent Application Publication Tokukai No. 2019-163079 (hereinafter may be referred to as an assembly type). Referring to Japanese Patent Application Publication Tokukai No. 2019-163079, the wall panels constituting the short-side surface parts 11 and 13, the long-side surface parts 12 and 14, the top surface part and the bottom surface part 16 of the heat insulating container X are prepared, and the prepared wall panels are assembled to produce the heat insulating container X. Then, the stored material T is fitted into the housing parts 11*a* to and the housing part of the bottom surface part 16 from outside of the heat insulating container X, thereby completing the constant-temperature transport container 10. The temperature-keeping target article may be housed in advance when the heat insulating container X is in an open state or may be stored after the stored material T has been set.

Thus, according to the configuration of the constant-temperature transport container 10, a housing part (housing parts 11*a* to 14*a*) for housing the stored material T is provided on the outer side of the container body of the heat insulating container X and in at least one surface selected from the group consisting of the short-side surface parts 11 and 13, the long-side surface parts 12 and 14, and the bottom surface part 16. This enables the stored material T to be inserted from outside of the heat insulating container X.

Here, the constant-temperature transport container described in Patent Literature 1 or 2 is produced by mounting heat storage materials on the individual wall panels and then assembling the wall panels. That is, the constant-temperature transport container described in Patent Literature 1 or 2 is configured such that the heat storage materials cannot be mounted in the state of the heat insulating container obtained by assembling the wall panels only. Thus, with the constant-temperature transport container described in Patent Literature 1 or 2, the constant-temperature transport container assembly can be constructed only after the heat storage materials have been mounted in the individual wall panels. Therefore, in the use in the form of the constant-temperature transport container assembly, the constant-temperature transport containers disclosed in Patent Literatures 1 and 2 have room for improvement in workability of setting the heat storage material with respect to each of the side surface parts and the bottom surface part.

The configuration of the constant-temperature transport container 10 in accordance with one or more embodiments enables the stored material T to be inserted from outside of the heat insulating container X. Thus, after the stored material T has been mounted in the housing part of the wall surface of the heat insulating container X, the constant-temperature transport container assembly can be constructed by connecting the heat insulating containers X to each other. Unlike the constant-temperature transport container described in Patent Literature 1 or 2, it is not necessary to mount the heat storage material in each of the wall panels. Therefore, according to the constant-temperature transport container 10 in accordance with one or more embodiments, it is possible to improve the workability of packing the stored material T with respect to the heat insulating container X. Further, when used in the form of a constant-temperature transport container assembly, the heat insulating container X can be prepared in advance for each constant-temperature transport container 10, and the stored material T can be pack at the time of construction of the constant-temperature transport container assembly. Therefore, it is possible to reduce the work at the time of construction of the constant-temperature transport container assembly. That is, according to the constant-temperature transport container 10 in accordance with one or more embodiments, it is possible to easily pack in a constant-temperature transport package. The constant-temperature transport container 10 in accordance with one or more embodiments brings about the above-described effect regardless of whether the heat insulating container X is the integral type or the assembly type. From the viewpoint of the ease of construction of a constant-temperature transport container assembly, the heat insulating container X may be the integral type. In addition, the size of the heat insulating container X is not particularly limited, but may be a hand-held size that is easily carried by a user's hand, from the viewpoint of the ease of construction of a constant-temperature transport container assembly.

Further, 104 of FIG. 1D is a plan view schematically illustrating a configuration of Variation 1 of the constant-temperature transport container 10. A constant-temperature transport container 10A as Variation 1 differs from the configurations illustrated in 101 to 103 of FIGS. 1A-C in that the luggage A inside the heat insulating container X further includes a stored material T0. The stored material T0 is a heat storage material P0. The heat storage material P0 may be the same as or different from the heat storage material P. In a case where the heat storage material P0 is different from the heat storage material P, the heat storage material P can indirectly control the temperature of the heat storage material P0 via a part interposed between the heat storage materials P and P0 in the heat insulating container X. Even with such a configuration, it is possible to improve the workability of packing the stored material T with respect to the heat insulating container X when used in the form of a constant-temperature transport container assembly.

It is not necessary that all of the stored materials T to be housed in the plurality of housing parts of the constant-temperature transport container 10 be the heat storage material P, and it is only required that the stored material T to be housed in at least one of the housing parts is the heat storage material P. 201 to 207 of FIGS. 2A-G are side views illustrating examples of the stored material T to be housed in the housing part of the constant-temperature transport container 10. It is assumed that the stored materials illustrated in 201 to 207 of FIGS. 2A-G are housed in the housing parts of the constant-temperature transport containers 10 illustrated in 101 and 102 of FIGS. 1A-B.

Figure 2A:
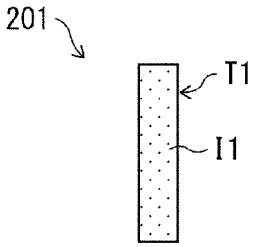

As illustrated in 201 of FIG. 2A, a stored material T1 may be a heat insulating material I1 that is fitted into the recess (for example, the recess 11*b* or the like) of the housing part. When used in the form of, for example, the constant-temperature transport container assembly 100, the stored material T1 functions as a gap filling material that fills a gap formed by housing parts which face each other between two adjacent heat insulating containers X.

Figure 2B:
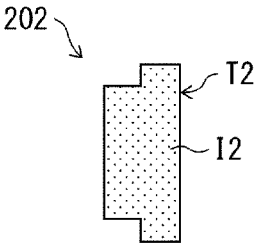

Further, as illustrated in 202 of FIG. 2B, the stored material T2 may be a heat insulating material 12 having a shape different from that of the heat insulating material I1. The heat insulating material 12 has a shape that is fitted into both the recess (for example, the recess 11*b* or the like) and the inner opening (for example, the inner opening 11*c* or the like) of the housing part. The heat insulating material 12 has a projection that is provided on the inner side and is fitted into the inner opening. The heat insulating material 12 is fitted into the housing part so as to be flush with a wall part which is a component of the luggage A.

In addition, in the configurations illustrated in 101 to 103 of FIGS. 1A-C, the stored material T is a single type of heat storage material P. However, as illustrated in 203 of FIG. 2C, a stored material T3 may be a collective body in which two heat storage materials P1 and P2 having different melting temperature ranges are laminated. In this case, the housing part in which the collective body is housed has a recess that is fitted to the luggage A-side shape of the collective body. That is, the collective body has a shape that is fitted into the recess (for example, the recess 11*b* or the like) of the housing part.

Figure 2C:
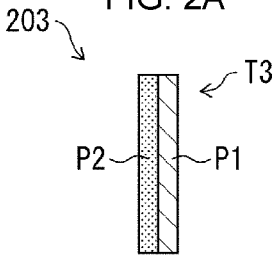
Figure 2D:
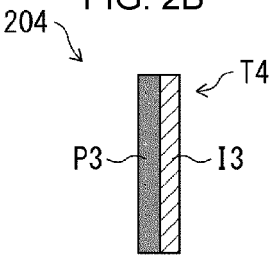

Further, as illustrated in 204 of FIG. 2D, a stored material T4 may be a collective body in which a heat storage material P3 and a heat insulating material 13 are laminated. In a manner similar to the stored material T3, the collective body has a shape that is fitted into the recess (for example, the recess 11*b* or the like) of the housing part. In addition, from the viewpoint of heat insulation property, it is preferable that the stored material T4 has a configuration in which the heat storage material P3 is disposed on the inner side.

Figure 2E:
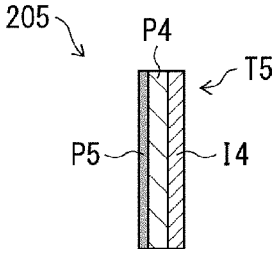

Further, as illustrated in 205 of FIG. 2E, a stored material T5 may be a collective body in which the heat storage materials P4 and P5 and the heat insulating material 14 are laminated. In a manner similar to the stored material T4 and the like, the collective body has a shape that is fitted into the recess (for example, the recess 11*b* or the like) of the housing part. The heat storage materials P4 and P5 have melting temperature ranges which are different from each other. In addition, from the viewpoint of heat insulation property, it is preferable that the stored material T5 has a configuration in which the heat storage materials P4 and P5 are disposed on the inner side.

Figure 2F:
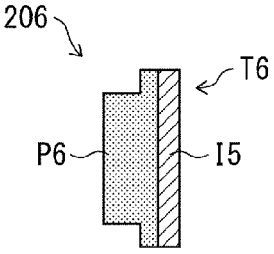

Further, as illustrated in 206 of FIG. 2F, a stored material T6 may be a collective body of a heat storage material P6 and a heat insulating material IS. From the viewpoint of heat insulation property, it is preferable that the stored material T6 has a configuration in which the heat storage material P6 is disposed on the inner side. In addition, the stored material T6 has a shape that is fitted into both the recess (for example, the recess 11*b* or the like) and the inner opening (for example, the inner opening 11*c* or the like) of the housing part. In this case, the housing part has a recess that is fitted to the luggage A-side shape of the stored material T6, that is, to the luggage A-side shape of the heat storage material P6. Specifically, the heat storage material P6 has a projection that is provided on the inner side and is fitted into the inner opening. The stored material T6 is fitted into the housing part so as to be flush with the wall part which is a component of the luggage A.

Figure 2G:
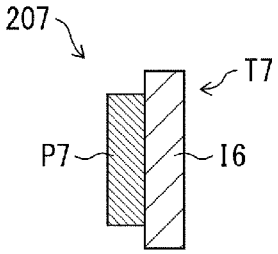

Further, as illustrated in 207 of FIG. 2G, a stored material T7 may be a collective body of a heat storage material P7 and a heat insulating material 16. The heat storage material P7 has a flat plate shape that is fitted to the inner opening (for example, the inner opening 11*c* or the like). The heat insulating material 16 has a flat plate shape that is fitted into the recess (for example, the recess 11*b* or the like) of the housing part. The heat storage material P7 is an article made of a plastic case including a heat storage component or a cold storage component (liquid) sealed therein. Therefore, the heat storage material P8 is not deformed in accordance with the posture of the stored material T7 when the stored material T7 has been mounted.

Figure 2H:
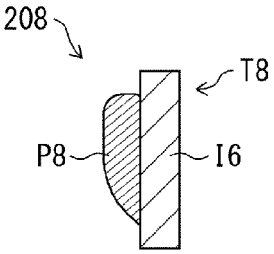

Further, as illustrated in 208 of FIG. 2H, a stored material T8 may be a collective body of a heat storage material P8 and a heat insulating material 16. The heat storage material P8 is a heat storage material in the form of a bag that fits in the inner opening (for example, the inner opening 11*c* or the like). The heat storage material P8 is an article made of a film bag including a heat storage component or a cold storage component (liquid) sealed therein. Therefore, the heat storage material P8 is deformed in accordance with the posture of the stored material T8 when the stored material T8 has been mounted.

Figure 2I:
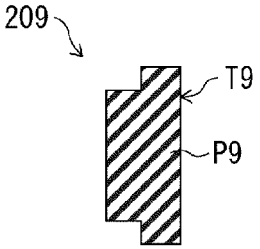

Further, as illustrated in 209 of FIG. 2I, a stored material T9 may be a heat storage material P9. The heat storage material P9 has a shape that is fitted into both the recess (for example, the recess 11*b* or the like) and the inner opening (for example, the inner opening 11*c* or the like) of the housing part. The heat storage material P9 has a projection that is provided on the inner side and is fitted into the inner opening. The heat storage material P9 is fitted into the housing part so as to be flush with the wall part which is a component of the luggage A.

(Housing State of the Stored Material T in the Housing Parts 11*a* to 16*a*)

Figure 3:
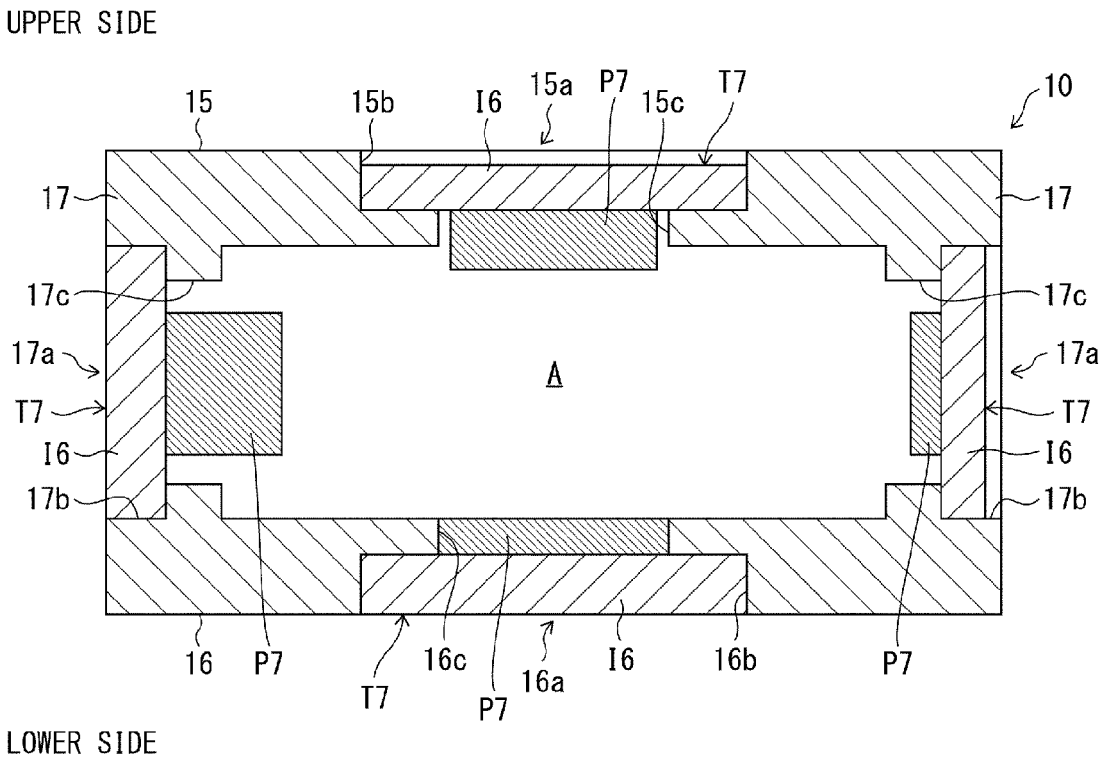
FIG. 3 is a cross-sectional view for describing housing states of stored materials in respective housing parts of side surface parts, a top surface part, and a bottom surface part of the constant-temperature transport container in accordance with Embodiment 1 of one or more embodiments of the present invention.

As described above, the stored material is fitted into the housing parts 11*a* to 16*a* so as to be flush with outer surfaces of the wall parts (the short-side surface parts 11 and 13, the long-side surface parts 12 and 14, the top surface part 15, and the bottom surface part 16) constituting the luggage A. However, the stored material does not necessarily have to be fitted into each of the housing parts 11*a* to 16*a*. FIG. 3 is a cross-sectional view for describing housing states of stored materials in respective housing parts of side surface parts, a top surface part, and a bottom surface part. Note that, in the following description, the stored material T7 illustrated in 207 of FIG. 2G will be taken as an example of the stored material. However, it is needless to say that the housing state of the stored material based on the following description does not apply only to the stored material T7. In addition, in FIG. 3, the short-side surface parts 11 and 13 and the long-side surface parts 12 and 14 are collectively referred to as side surface parts 17, and housing parts, recesses, and inner openings of the side surface parts 17 are referred to as housing parts 17*a*, recesses 17*b*, and inner openings 17*c*.

The heat insulating material 16 disposed on the outer side in the stored material T7 has a shape that is fitted into the recess 15*b*, 16*b*, or 17*b*. Further, the heat insulating material 16 does not deform in accordance with the posture of the stored material T7 when the stored material T7 has been mounted. In addition, the heat insulating material 16 may be fitted so as to be flush with the outer surfaces of the wall parts (the top surface part 15, the bottom surface part 16, and the side surface parts 17) constituting the luggage A.

In addition, it is only required that the heat storage material P7 disposed on the inner side in the stored material T7 has any part that is housed in the inner opening 15*c* or 17*c* in the housing part 15*a* or 17*a*. That is, as long as the temperature-keeping target article in the luggage A is not damaged, an inner end surface of the heat storage material P7 may be located inward or outward of the inner surface of the top surface part 15 or of the side surface part 17. Further, the heat storage material P7 may be in contact with or spaced from wall parts constituting the inner opening 15*c* or 17*c*. The heat storage material P7 may be flush with the inner surface of the top surface part 15 or the side surface part 17.

In addition, in the housing part 15*a* or 17*a*, the stored material T8 illustrated in 208 of FIG. 2H may be housed instead of the stored material T7. That is, the heat storage material disposed on the inner side may be the heat storage material P8 which is an article made of a film bag or the like including a heat storage component or a cold storage component (liquid) sealed therein.

On the other hand, in the housing part 16*a*, it is preferable that an inner end surface of the heat storage material P7 is flush with an inner surface of the bottom surface part 16. In a case where the inner end surface of the heat storage material P7 is not flush with the inner surface of the bottom surface part 16, a raised part and a recessed part is generated in the inner surface of the bottom surface part 16. Thus, when the temperature-keeping target article is placed in the luggage A, there is a possibility that the temperature-keeping target article cannot be placed horizontally.

Figure 4:
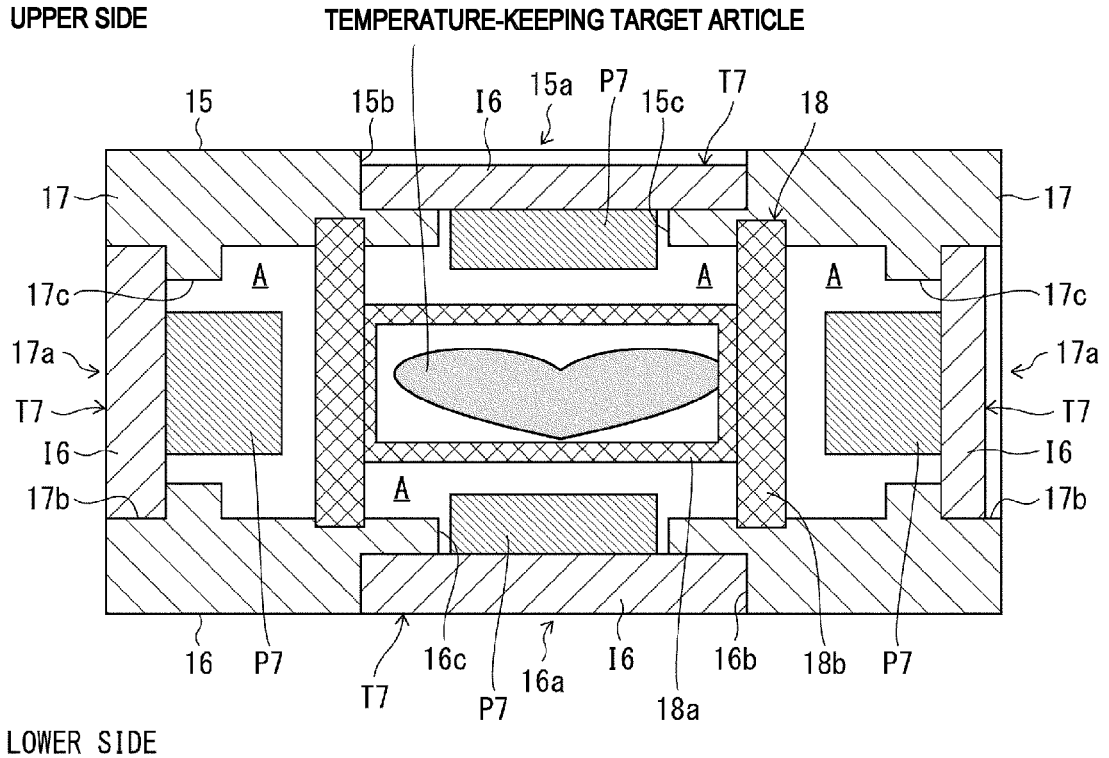
FIG. 4 is a cross-sectional view illustrating a configuration example of a constant-temperature transport container capable of horizontally placing a temperature-keeping target article in a case where an end surface of a heat storage material is disposed inward of the inner surface of the bottom surface part.

Note that, as long as the constant-temperature transport container has a structure in which the temperature-keeping target article can be placed horizontally, the end surface of the heat storage material P7 may not be flush with the inner surface of the bottom surface part 16. FIG. 4 is a cross-sectional view illustrating a configuration example of a constant-temperature transport container capable of horizontally placing a temperature-keeping target article in a case where the end surface of the heat storage material P7 is disposed inward of the inner surface of the bottom surface part 16.

As illustrated in FIG. 4, in the housing parts 15*a*, 16*a*, and 17*a*, the heat storage material P7 is housed such that the inner end surface of the heat storage material P7 is located inward of each of the respective inner surfaces of the top surface part 15, the bottom surface part 16, and the side surface parts 17. Therefore, a raised part is generated on each of the respective inner surfaces of the top surface part 15, the bottom surface part 16, and the side surface parts 17.

Here, the constant-temperature transport container illustrated in FIG. 4 includes an article holder 18 which is provided inside the luggage A. The article holder 18 includes an article holder main body 18*a* and a support part 18*b*. The article holder main body 18*a* constitutes a space for housing the temperature-keeping target article. The support part 18*b* supports the article holder main body 18*a* in the luggage A. The support part 18*b* is disposed so as to be spaced from the side surface parts 17, extends in an up-down direction, and abuts on the top surface part 15 and the bottom surface part 16. The article holder main body 18*a* is supported by the support part 18*b* so as to be spaced from the respective inner surfaces of the top surface part 15, the bottom surface part 16, and the side surface parts 17. Therefore, it is possible to place the temperature-keeping target article horizontally. Note that, for example, even if the fitted stored material T7 comes off, and a part of the stored material T7 protrudes inwardly, the temperature-keeping target article can be protected from the stored material T7 by the article holder 18.

Figure 5:
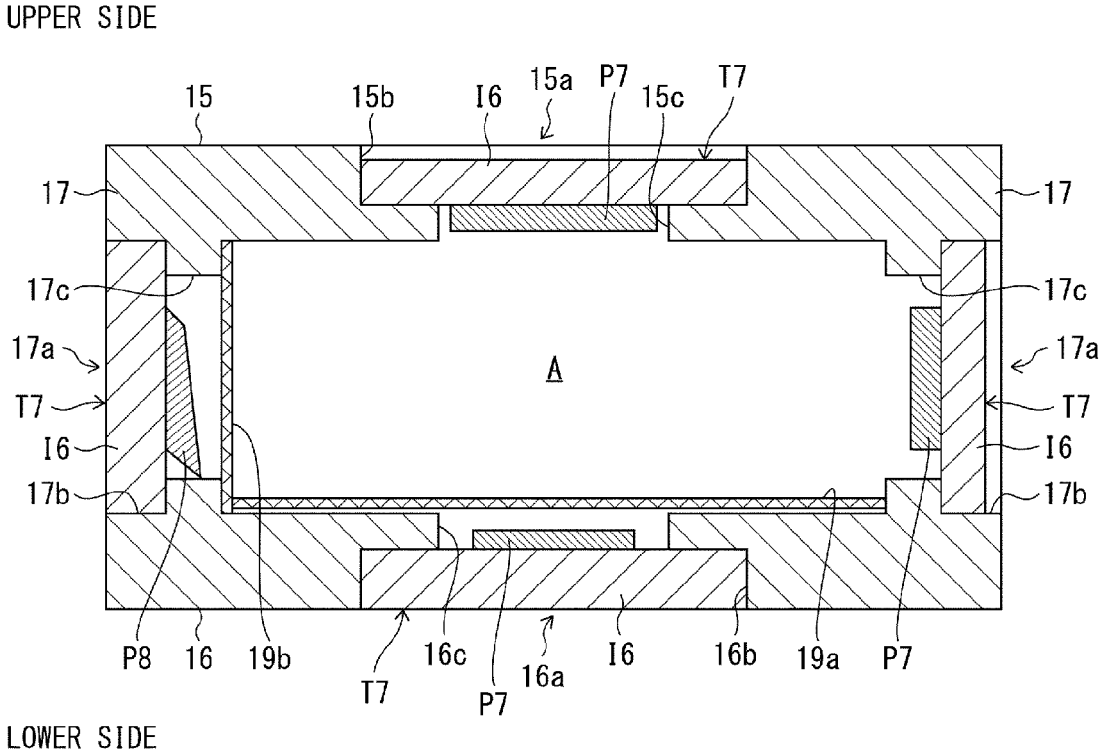
FIG. 5 is a cross-sectional view illustrating a configuration example of a constant-temperature transport container capable of horizontally placing a temperature-keeping target article in a case where the end surface of the heat storage material is disposed outward of the inner surface of the bottom surface part.

FIG. 5 is a cross-sectional view illustrating a configuration example of a constant-temperature transport container capable of horizontally placing a temperature-keeping target article in a case where the end surface of the heat storage material P7 is disposed outward of the inner surface of the bottom surface part 16.

As illustrated in FIG. 5, in the housing parts 15*a* and 16*a*, the heat storage material P7 is housed such that the inner end surface of the heat storage material P7 is located outward of each of the respective inner surfaces of the top surface part 15 and the bottom surface part 16. In addition, the stored material T8 illustrated in 208 of FIG. 2H is housed in at least one housing part 17*a* among the housing parts 17*a* of the four side surface parts 17, and the stored material T7 is housed in the other housing parts 17*a*. In the housing parts 17*a* of the side surface parts 17, the heat storage material P7 or P8 is housed such that the inner end surface of the heat storage material P7 or P8 is located outward of each of the respective inner surfaces of the side surface parts 17. Therefore, a recessed part is generated on each of the respective inner surfaces of the top surface part 15, the bottom surface part 16, and the side surface parts 17.

Here, the constant-temperature transport container illustrated in FIG. 5 includes wall tools 19*a* and 19*b* which are provided inside the luggage A. The wall tool 19*a* is a flat plate that covers at least the inner opening 16*c*. Further, the wall tool 19*b* is a flat plate that covers at least the inner opening 17*c* of the housing part 17*a* in which the stored material T8 is housed.

The wall tool 19*a* makes the inner surface of the bottom surface part 16 flat. Therefore, it is possible to place the temperature-keeping target article horizontally.

Note that the wall tool 19*b* provided to the side surface part 17 may be provided as necessary. For example, in a case where the wall tool 19*b* is provided for the stored material T8 as illustrated in FIG. 5, it is possible to prevent the deformable heat storage material P8 from protruding inwardly.

601 and 602 of FIGS. 6A-B are perspective views respectively illustrating configurations of Variations 2 and 3 of the constant-temperature transport container 10 in accordance with one or more embodiments. The constant-temperature transport containers 10B and 10C in Variations 2 and 3 differ from the configurations illustrated in 101 to 103 of FIGS. 1A-C in that different types of stored materials are to be housed in the respective housing parts.

As illustrated in 601 of FIG. 6A, in the constant-temperature transport container 10B of Variation 2, the stored material T which is the heat storage material P is housed in the housing part 11*a* of the short-side surface part 11. In addition, stored materials of the same kind are housed in both the housing part 12*a* of the long-side surface part 12 and the housing part 15*a* of the top surface part 15, and, for example, the stored material T1 (heat insulating material I1) illustrated in 201 of FIG. 2A is housed therein. The stored materials to be housed in the housing parts 12*a* and 15*a* are not particularly limited as long as they are of the same kind, and, for example, the stored materials T2 to T9 illustrated in 201 to 209 of FIGS. 2A-I can be housed therein.

As illustrated in 602 of FIG. 6B, in the constant-temperature transport container 10C of Variation 3, different types of stored materials are housed respectively in the housing part 11*a* of the short-side surface part 11, the housing part 12*a* of the long-side surface part 12, and the housing part 15*a* of the top surface part 15. For example, the stored material T3 illustrated in 203 of FIG. 2C is housed in the housing part 11*a* of the short-side surface part 11. In addition, the stored material T4 illustrated in 204 of FIG. 2D is housed in the housing part 12*a* of the long-side surface part 12. Furthermore, the stored material T1 (heat insulating material I1) illustrated in 201 of FIG. 2A is housed in the housing part 15*a* of the top surface part 15. The stored materials to be housed in the housing parts 11*a*, 12*a*, and 15*a* are not particularly limited as long as they are of types different from each other, and, for example, the stored materials T2 to T9 illustrated in 201 to 209 of FIGS. 2A-I can be housed in combination as appropriate.

(Material of Heat Insulating Container X)

Here, there is no particular limitation on the material of the heat insulating container X, provided that the material has a heat insulating property. The material of the heat insulating container X may be a foamed plastic or a vacuum heat insulating material. Specific examples of the foamed plastic include foamed polystyrene, foamed polyethylene, foamed polypropylene, foamed polyurethane, and a foamed poly(3-hydroxyalkanoate)-based resin. In a case where the foamed plastic is used, it is also possible to form foamed plastic particles into a container in advance by molding the foamed plastic particles into a mold, and it is also possible to form a plate-like foamed plastic board into a container by cutting and assembling. Especially, considering that a large number of containers are mounted on a pallet to form an assembly, easier handling is provided by using the container formed by in-mold molding of the foamed plastic particles than by using the plate-like foamed plastic board. The foamed plastic may be the one containing a radiative heat transfer inhibitor, since such a foamed plastic is excellent in the heat insulating property. Examples thereof include a carbon-containing bead foamed molded body containing carbon that can act as a radiative heat transfer inhibitor. Examples of the carbon include graphite, graphene, active carbon, coke, and carbon black. In terms of balance between the cost and the effect of enhancing the heat insulating property, the carbon may be graphite or carbon black, or graphite. Examples of the vacuum heat insulating material include the ones including, as a core, silica powder, glass wool, glass fiber, and/or the like.

Further, the heat insulating container X may be made of two or more kinds of foamed plastic used in combination. Specific examples of the combination include a combination of a foamed body obtained by foaming polyethylene and a foamed body obtained by foaming polystyrene.

Further, the heat insulating container X may be made of a combination of a foamed plastic and a vacuum heat insulating material. In this case, the vacuum heat insulating material may be used to cover outer surfaces or inner surfaces of the heat insulating container X made of the foamed plastic, or the vacuum heat insulating material may be buried in the insides of the walls constituting the heat insulating container X. This can yield a transport container having a high heat insulating property.

(Heat Storage Materials)

The heat storage materials P and P0 to P9 (hereinafter can be simply referred to as heat storage materials) used in one or more embodiments will be described. The "heat storage material" herein encompasses not only the heat storage material but also a cold storage material. That is, each of the stored materials used in one or more embodiments includes at least one of the heat storage material and the cold storage material. The heat storage material or the cold storage material is an article made of a plastic case or a film bag including a heat storage component or a cold storage component sealed therein. Note that, in a case where the article made of a film bag or the like including a heat storage component or a cold storage component sealed therein is used as the heat storage material, the heat storage material deforms in accordance with the posture of the stored material. Therefore, in this case, the heat storage material is disposed innermost. For example, in a case where the heat storage material is applied to the stored material T5 illustrated in 205 of FIG. 2E, the heat storage material cannot be applied to the heat storage material P4, but the heat storage material can be applied to the heat storage material P5.

There is no particular limitation on the material of the plastic case or film bag filled with the heat storage component or the cold storage component. Examples of the material include polyethylene, polypropylene, polyethylene terephthalate, polystyrene, polyvinyl chloride, nylon, and polyester. One kind selected from these materials may be used alone. Alternatively, in order to enhance the heat resistance and/or the barrier property, a multi-layer structure made of two or more kinds selected from these materials may be used. There is no particular limitation on the shape of the plastic case or film bag. From the viewpoint of enhancing the heat exchange efficiency, the plastic case or film bag may have a shape that can secure a large surface area.

Each of the heat storage materials may be at least either of the latent heat type heat storage material and the latent heat type cold storage material. The latent heat type heat storage material or the latent heat type cold storage material is a material that uses heat energy associated with phase transition of the heat storage component or the cold storage component and that utilizes heat energy absorbed when the phase state of the heat storage component or the cold storage component changes from a solidified state (solid) to a melted state (liquid) or heat energy released when the phase state of the heat storage component or the cold storage component changes from a melted state (liquid) to a solidified state (solid).

A solidifying/melting temperature of the heat storage component or the cold storage component refers to a temperature at which the phase state of the heat storage component or the cold storage component changes from a solidified state (solid) to a melted state (liquid) or from a melted state (liquid) to a solidified state (solid). The "melting temperature" of a cold storage material composition as used herein is intended to mean "a temperature at which the cold storage material composition in a solid state starts melting into a liquid state". The "melting temperature" will be more specifically discussed with reference to FIG. 7. FIG. 7 is a graph plotting a change over time in temperature of a cold storage material composition when a cold storage material composition in a solidified state was placed in a thermostatic bath, and the temperature of the thermostatic bath was then increased from a cryogenic temperature at a constant rate of temperature increase. In comparison with the temperature of the thermostatic bath which is increased at a constant rate, the temperature of the cold storage material composition, as shown in FIG. 7, changes in the order of the following (1) to (3): (1) The temperature of the cold storage material composition increases at a constant rate; (2) after temperature $T_1$, there is little change due to latent heat of the cold storage material composition, and the temperature of the cold storage material composition stays constant from the temperature $T_1$ to temperature $T_2$; and (3) the temperature of the cold storage material composition starts increasing again after the temperature $T_2$. The temperature $T_1$ as used herein is referred to as "melting start temperature", and the temperature $T_2$ as used herein is referred to as "melting end temperature". A midpoint between the temperature $T_1$ and the temperature $T_2$, i.e., temperature $T_3$, is defined herein as "melting temperature".

Generally, the phase state refers to any one of three phase states of a substance, i.e., solid, liquid, and gas. One or more embodiments utilize the solid phase state and the liquid phase state among these. The phase state of the heat storage component or the cold storage component refers to a phase state of not less than 50 wt %. For example, a phase state in which 80 wt % of the heat storage component is in a solid state and 20 wt % of the heat storage component is in a liquid state is solid (solidified state).

The composition constituting the latent heat type heat storage component or the latent heat type cold storage component used in one or more embodiments is not particularly limited. As the composition, the compositions disclosed in, for example, International Publication Nos. WO 2014/125878, WO 2019/151074, WO 2016/068256, WO 2019/172260, WO 2018/180506, and the like can be used.

In a constant-temperature transport container in accordance with one or more embodiments, one kind of the heat storage material(s) and/or the cold storage material(s) (either or both of the heat storage material(s) and the cold storage material(s)) may be placed and housed. In a case where the ambient temperature is lower than the controlled temperature, e.g., in winter, temperature adjustment is carried out at a temperature higher than the solidifying/melting temperature of the heat storage material(s) and/or the cold storage material(s) that is/are to be placed and stored in the container, so that the heat storage material(s) and/or the cold storage material(s) in a melted state is/are placed in the container. In this case, when the heat storage material(s) and/or the cold storage material(s) is/are cooled by the ambient temperature, the temperature(s) thereof degrease(s) and the phase(s) thereof transition(s) from a melted state (liquid) to a solidified state (solid), so that the heat storage material and/or the cold storage material release(s) heat energy. This can suppress exposure of the temperature-keeping target article to the external air, thereby maintaining the temperature of the temperature-keeping target article within a given temperature range.

Meanwhile, in a case where the ambient temperature is higher than the controlled temperature, e.g., in summer, temperature adjustment is carried out at a temperature lower than the solidifying/melting temperature of the heat storage material(s) and/or the cold storage material(s) that is/are to be placed and stored in the container, and the heat storage material(s) and/or the cold storage material(s) in a solidified state is/are placed in the container. In this case, when the heat storage material(s) and/or the cold storage material(s) is/are heated by the ambient temperature, the temperature(s) thereof increase(s) and the phase(s) thereof transition(s) from a solidified state (solid) to a melted state (liquid), so that the heat storage material(s) and/or the cold storage material(s) absorb(s) heat energy. This can suppress exposure of the temperature-keeping target article to the external air, thereby maintaining the temperature-keeping target article within a given temperature range.

In a case where one kind of the constant-temperature transport container employs the heat storage material(s) and/or the cold storage material(s) is/are used, effects of temperature increase or decrease caused by a temperature difference between the heat storage material(s) and/or the cold storage material(s) and the external air can be suppressed, via the heat insulating material constituting the constant-temperature transport container, by the releasing/absorbing effect of latent heat energy of the single kind of the heat storage material(s) and/or the cold storage material(s), and accordingly the temperature-kept article can be maintained within a given temperature range for a certain time. For this, however, the heat storage material(s) and/or the cold storage material(s) need to be adjusted in advance at a specific temperature with respect to the external ambient temperature, and this is troublesome. Further, in a case where the temperature is to be maintained for a long time, the number/weight of the heat storage material(s) and/or the cold storage material(s) tend to increase.

In one or more embodiments, a plurality of heat storage materials having different melting temperature ranges may be used. In the constant-temperature transport container in accordance with one or more embodiments, two or more kinds of the heat storage material(s) and/or the cold storage material(s) having different solidified/melted states can be placed and stored in the stored material P3, as shown, for example, in 203 of FIG. 2C. For example, in a case where the first heat storage material or cold storage material (a) and the second heat storage material or cold storage material (b) are used and the same temperature adjustment conditions are employed throughout an year regardless of the ambient temperature, the following combinations of the heat storage materials P1 and P2 may be employed, for example. One example of the combination includes: the heat storage material P1 which is located close to the temperature-keeping target article and in which the first heat storage material or cold storage material (a) having a solidifying/melting temperature close to the controlled temperature and being in a melted state is stored; and the heat storage material P2 which is located outward of the first heat storage material or cold storage material and in which the second heat storage material or cold storage material (b) having a solidifying/melting temperature not more than 0° C. and being in a solidified state is stored.

In a case where the first heat storage material or cold storage material (a) and the second heat storage material or cold storage material (b) are used, temperature adjustment may be carried out so that the first heat storage material or cold storage material (a) is in a melted state at a temperature higher than the controlled temperature and the second heat storage material or cold storage material (b) may be solidified and frozen at a temperature not more than the melting temperature of the second heat storage material or cold storage material (b). In this case, the first heat storage material or cold storage material (a) is housed in the heat storage material P2 located close to the temperature-keeping target article, and the second heat storage material or cold storage material (b) is housed in the heat storage material P1. The second heat storage material or cold storage material (b) located outward of the first heat storage material or cold storage material (a) functions as a thermal buffer material for the ambient temperature in order to maintain the temperature-keeping target article within a desired temperature range.

In a case where these two or more kinds of heat storage material(s) and/or cold storage material(s) having different solidified/melted states are used, effects of temperature increase and decrease caused by a temperature difference between the heat storage material(s) and/or the cold storage material(s) and the external air can be suppressed by causing, via the heat insulating materials constituting the container, the second heat storage material or cold storage material (b) which is disposed outward of the first heat storage material or cold storage material (a) disposed adjacent to the temperature-keeping target article to function as a thermal buffer material. Further, due to a temperature interaction between the first heat storage material or cold storage material (a) and the second heat storage material or cold storage material (b), the first heat storage material or cold storage material (a) that is in a melted state is cooled and accordingly the temperature thereof decreases and transitions from a melted state (liquid) to a solidified state (solid), so as to release heat energy. This makes it possible to protect the temperature-keeping target article from both a temperature higher than the temperature of the temperature-keeping target article and a temperature lower than the temperature of the temperature-keeping target article. Consequently, it is possible to reduce an amount of the heat storage material(s) or cold storage material(s) to be used and to maintain the temperature-keeping target article within a given temperature range for a longer time.

(Configuration of Constant-Temperature Transport Container Assembly)

FIG. 8 is a diagram schematically illustrating a configuration example of the constant-temperature transport container assembly in accordance with one or more embodiments. In FIG. 8, for the sake of simplicity of the drawing, the stored materials and the housing parts are omitted. A constant-temperature transport container assembly 100A has a configuration in which constant-temperature transport containers 10 are loaded in relatively small quantity (about one stage) on a pallet 20. Further, a constant-temperature transport container assembly 100B has a configuration in which constant-temperature transport containers 10 are loaded in medium quantity on the pallet 20. Further, a constant-temperature transport container assembly 100C has a configuration in which constant-temperature transport containers 10 are loaded in large quantity on the pallet 20. According to one or more embodiments, the constant-temperature transport container is provided with a projection-and-recess fitting part. Thus, it is possible to realize a constant-temperature transport container assembly that enables the quantity of the constant-temperature transport containers 10 to be loaded to be set as appropriate by fitting the adjacent constant-temperature transport containers 10 together and that enables the constant-temperature transport containers 10 to be stably held. Note that the constant-temperature transport container assembly 100B in which the constant-temperature transport containers 10 are loaded in medium quantity or the constant-temperature transport container assembly 100C in which the constant-temperature transport containers 10 are loaded in large quantity may be provided with a cover 30 for covering the loaded constant-temperature transport containers 10. The provision of the cover 30 brings about the following effects. (a) It is possible to strengthen fixing between the constant-temperature transport containers 10 that are fitted to each other. (b) It is possible to enhance adhesion between the constant-temperature transport containers 10 that are fitted to each other and reduce a gap between the constant-temperature transport containers 10. (c) It is possible to retain cool air or hot air leaking from the gap between the constant-temperature transport containers 10 that are fitted to each other. (d) It is possible to avoid direct damage, from outside, to the constant-temperature transport containers 10.

Here, in general, in a case where temperature-keeping target articles are constant-temperature-transported with use of one large constant-temperature transport container, there is a risk that, when the constant-temperature transport container is partially damaged, the temperatures of all of the temperature-keeping target articles housed in the constant-temperature transport container cannot be maintained. According to the constant-temperature transport container assemblies 100A to 100C in accordance with one or more embodiments, even if the constant-temperature transport container assemblies 100A to 100C are partially damaged, the temperature of only the temperature-keeping target article housed in the damaged constant-temperature transport container 10 cannot be maintained, and the temperature of the temperature-keeping target article housed in the constant-temperature transport container 10 that is not damaged can be maintained. Thus, according to the constant-temperature transport container assemblies 100A to 100C, only the damage appears as the inability to maintain the temperature of the temperature-keeping target article in only the damaged constant-temperature transport container 10. Therefore, the risk of constant-temperature transport can be reduced.

(Fitting Between Constant-Temperature Transport Containers)

In the configuration illustrated in FIG. 8, the fitting structure between the constant-temperature transport containers 10 is omitted. The fitting structure between the constant-temperature transport containers 10 is not particularly limited as long as it is a known fitting structure. Examples of the fitting structure between the constant-temperature transport containers 10 include the fitting structure disclosed in Japanese Patent Application Publication Tokukai No. 2019-131278. FIGS. 9A-B illustrate an example of the fitting structure between the constant-temperature transport containers 10, 901 of FIG. 9A is a plan view, and 902 of FIG. 9B is a perspective view. The fitting structure between the constant-temperature transport containers 10 is not limited to the configuration illustrated in FIGS. 9A-B. In FIGS. 9A-B, for the sake of simplicity of the drawing, the stored materials and the housing parts are omitted.

As illustrated in 901 and 902 of FIGS. 9A-B, the plurality of constant-temperature transport containers 10 are structured so as to be fitted and connected to each other. That is, in the constant-temperature transport container 10, the projection-and-recess fitting part is formed on at least one surface selected from the group consisting of the side surface parts, the top surface part, and the bottom surface part of the heat insulating container X, which is the main body, so as to enable connection with a heat insulating container of another constant-temperature transport container 10.

As illustrated in 901 and 902 of FIGS. 9A-B, in the constant-temperature transport container 10, a long projection 10*a* and a recessed groove 10*b* that is to be fitted to the long projection 10*a* are formed as the projection-and-recess fitting part so as to enable connection, at each of the side surface parts of the heat insulating container X, with a heat insulating container X of another constant-temperature transport container 10. The long projection 10*a* and the recessed groove 10*b* are each provided in the corresponding side surface parts of the heat insulating container X that face each other in the horizontal direction.

Further, in the constant-temperature transport container 10, a long projection 10*c* and a recessed groove (not illustrated) that is to be fitted to the long projection 10*c* are formed as the projection-and-recess fitting part so as to enable connection, at the top surface part of the heat insulating container X or the bottom surface part thereof, with a heat insulating container X of another constant-temperature transport container 10.

Since the plurality of constant-temperature transport containers 10 are structured so as to be fitted and connected to each other in this manner, it is possible to construct a stable constant-temperature transport container assembly.

A specific configuration of the constant-temperature transport container assembly in accordance with one or more embodiments will be described in detail. 1001 to 1003 of FIGS. are cross-sectional views each illustrating a configuration example of a constituent unit having two constant-temperature transport containers applicable to the constant-temperature transport container assembly in accordance with one or more embodiments. 1001 to 1003 of FIGS. 10A-C illustrate longitudinal cross sections each obtained by cutting the constant-temperature transport container assembly in the vertical direction. Note that the constituent unit having two constant-temperature transport containers in the constant-temperature transport container assembly in accordance with one or more embodiments is not limited to the configurations illustrated in 1001 to 1003 of FIGS. 10A-C.

As illustrated in 1001 of FIG. 10A, the constant-temperature transport container assembly in accordance with one or more embodiments may include a constituent unit constituted by constant-temperature transport containers 10D and 10E. In the constant-temperature transport container 10D, the stored material T4 is housed in a housing part 13*a* of a short-side surface part 13, a housing part 15*a* of a top surface part 15, and a housing part 16*a* of a bottom surface part 16. The stored material T4 may be a collective body of the heat storage material P3 and the heat insulating material 13, wherein the heat storage material P3 is disposed on the inner side, and the heat insulating material 13 is disposed on the outer side. Further, in the constant-temperature transport container 10E, the stored material T4 is housed in a housing part 11*a* of a short-side surface part 11, a housing part 15*a* of a top surface part 15, and a housing part 16*a* of a bottom surface part 16.

In two adjacent surfaces of the constant-temperature transport containers 10D and 10E, the stored material T3 is housed in the housing part 11*a* of the short-side surface part 11 of the constant-temperature transport container 10D. On the other hand, the stored material T3 is housed in the housing part 13*a* of the short-side surface part 13 of the constant-temperature transport container 10E. The stored material T3 is a collective body of the heat storage materials P1 and P2. In the housing parts 11*a* and 13*a*, the stored material T3 has a configuration in which the heat storage material P2 is disposed on the inner side, and the heat storage material P1 is disposed on the outer side.

It can be said that the constant-temperature transport container assembly illustrated in 1001 of FIG. 10A has a configuration in which a stored material constituted by the two types of heat storage materials P1 and P2 are housed in a partition wall part that partitions a luggage of the constant-temperature transport container 10D and a luggage of the constant-temperature transport container 10E. In addition, it can be said that the stored material has a configuration in which the heat storage materials P1 are sandwiched between the two respective heat storage materials P2 disposed inside the constant-temperature transport containers 10D and 10E. In one or more embodiments, the melting temperatures of the heat storage materials P2 and P3 are the same. In one or more embodiments, the melting temperature of the heat storage material P1 is equal to or lower than the melting temperature of the heat storage material P2 so that the time for maintaining the heat storage material P2 in the constant temperature state (2) in FIG. 7 can be prolonged.

Further, as illustrated in 1002 of FIG. 10B, the constant-temperature transport container assembly in accordance with one or more embodiments may include a constituent unit constituted by constant-temperature transport containers 10F and 10G. In the constant-temperature transport container 10F, the stored material T2 is housed in the housing part 13*a* of the short-side surface part 13 and the housing part 16*a* of the bottom surface part 16. Further, the stored material T4 (the heat insulating material I3 and the heat storage material P3) is housed in the housing part 15*a* of the top surface part 15. The stored material T2 is constituted by the heat insulating material I2. In each of the housing parts 13*a* and 16*a*, the heat insulating material I2 has an outer part that is to be fitted into each of the recesses 13*b* and 16*b* and has a projection that is disposed on the inner side and that is to be fitted into each of the inner openings 13*c* and 16*c*. In the constant-temperature transport container 10G, the stored material T2 is housed in the housing part 11*a* of the short-side surface part 11 and the housing part 16*a* of the bottom surface part 16. Further, the stored material T4 is housed in the housing part 15*a* of the top surface part 15.

In two adjacent surfaces of the constant-temperature transport containers 10F and 10G, the stored material T7 is housed in both the housing part 11*a* of the short-side surface part 11 of the constant-temperature transport container 10F and the housing part 13*a* of the short-side surface part 13 of the constant-temperature transport container 10G. The stored material T7 is constituted by the heat storage material P7. In each of the housing part 11*a* of the constant-temperature transport container 10F and the housing part 13*a* of the constant-temperature transport container 10G, the heat storage material P7 has an outer part that is to be fitted into each of the recesses 11*b* and 13*b* and has a projection that is disposed on the inner side and that is to be fitted into each of the inner openings 11*c* and 13*c*. It can be said that the constant-temperature transport container assembly illustrated in 1002 of FIG. 10B has a configuration in which a stored material constituted by the heat storage materials P7 are housed in a partition wall part that partitions a luggage of the constant-temperature transport container 10F and a luggage of the constant-temperature transport container 10G. In one or more embodiments, the melting temperatures of the heat storage materials P3 and P7 are the same. Further, the configuration illustrated in 1002 of FIG. 10B includes the stored material T2. Therefore, the heat insulating material 12 is used as a part of the stored material that is exposed inside the luggage. It can be said that the configuration illustrated in 1002 of FIG. 10B is a configuration example in which the time for maintaining the heat storage material P in the constant temperature state (2) in FIG. 7 is controlled to be long or short by reducing the amount of the heat storage material used.

Further, as illustrated in 1003 of FIG. 10C, the constant-temperature transport container assembly in accordance with one or more embodiments may include a constituent unit constituted by constant-temperature transport containers 10H and 10I The constant-temperature transport containers 10H and 10I differ from the constant-temperature transport containers 10D and 10E illustrated in 1001 of FIG. 10A in the configurations of housing parts 11*a*', 13*a*', 15*a*', and 16*a*'. The housing parts 11*a*', 13*a*', 15*a*', and 16*a*' of the constant-temperature transport container 10H have partition walls 11*d*, 13*d*, 15*d*, and 16*d*, respectively, that partition the recesses 11*b*, 13*b*, 15*b*, and 16*b*, respectively, and the luggage. The same applies to housing parts 11*a*', 13*a*', and 16*a*' of the constant-temperature transport container 10I. That is, in the constant-temperature transport container in accordance with one or more embodiments, the housing parts in which the heat storage materials are housed and the luggage may not be in communication with each other, or a plurality of communication holes may be present in the partition walls 11*d*, 13*d*, 15*d*, and 16*d*. The partition walls 11*d*, 13*d*, 15*d*, and 16*d* need only be thick enough to transmit latent heat of the heat storage materials to be housed to the luggage. Since the partition walls 11*d*, 13*d*, 15*d*, and 16*d* are present as heat insulating layers, it is possible to prolong the time for maintaining the heat storage materials P2 and P3 in the constant temperature state (2) in FIG. 7.

1101 to 1103 of FIGS. 11A-C are cross-sectional views each illustrating a configuration example of a constituent unit having four constant-temperature transport containers applicable to the constant-temperature transport container assembly in accordance with one or more embodiments. The constituent unit having four constant-temperature transport containers is a unit in which two constant-temperature transport containers connected in a horizontal direction are loaded in two stages. 1101 to 1103 of FIGS. 11A-C illustrate longitudinal cross sections each obtained by cutting the constant-temperature transport container assembly in the vertical direction. Note that the constituent unit having four constant-temperature transport containers in the constant-temperature transport container assembly in accordance with one or more embodiments is not limited to the configurations illustrated in 1101 to 1103 of FIGS. 11A-C.

The constant-temperature transport container assembly illustrated in 1101 of FIG. 11A has, as a constituent unit, four constant-temperature transport containers 10J. In the constant-temperature transport container 10J, the stored material T which is the heat storage material P is housed in a housing part 11*a* of a short-side surface part 11, a housing part 13*a* of a short-side surface part 13, a housing part 15*a* of a top surface part 15, and a housing part 16*a* of a bottom surface part 16.

The constant-temperature transport container assembly illustrated in 1102 of FIG. 11B has, as a constituent unit, four constant-temperature transport containers 10K. In the constant-temperature transport container 10K, the stored material T4 is housed in the housing part 11*a* of the short-side surface part 11, the housing part 13*a* of the short-side surface part 13, the housing part 15*a* of the top surface part and the housing part 16*a* of the bottom surface part 16.

The constant-temperature transport container assembly illustrated in 1103 of FIG. 11C has, as a constituent unit, two constant-temperature transport containers 10L and two constant-temperature transport containers 10M. In this constituent unit, the two constant-temperature transport containers 10L are connected to each other in the horizontal direction. In addition, the two constant-temperature transport containers 10M are connected to each other in the horizontal direction. Furthermore, in the vertical direction, to an upper stage of a connected body of the constant-temperature transport containers 10M, a connected body of the constant-temperature transport containers 10L is connected.

In the constant-temperature transport container 10L, the stored material T4 is housed in the housing part 11*a* of the short-side surface part 11, the housing part 13*a* of the short-side surface part 13, and the housing part 15*a* of the top surface part 15. Further, in the constant-temperature transport container 10M, the stored material T4 is housed in the housing part 11*a* of the short-side surface part 11, the housing part 13*a* of the short-side surface part 13, and the housing part 16*a* of the bottom surface part 16.

A single stored material T10 is housed in a housing part formed by two surfaces adjacent to each other in the up-down direction in the constant-temperature transport containers 10L and 10M. The stored material T10 has a configuration in which a heat insulating material I10 is sandwiched between two heat storage materials P10. In the constant-temperature transport containers 10L and 10M that are adjacent to each other in the up-down direction, the housing part 16*a* of the bottom surface part 16 of the constant-temperature transport container 10L and the housing part 15*a* of the top surface part of the constant-temperature transport container 10M communicate with each other and constitute one space. The stored material T10 is housed in the one space.

With such a configuration, it is only necessary to use one stored material T10 for the connecting part between the constant-temperature transport containers 10L and 10M, and the number of parts can be reduced. Furthermore, the stored material T10 itself can also assist fitting of the constant-temperature transport containers 10L and 10M in the up-down direction.

Next, with reference to FIGS. 12 to 14, a constant-temperature transport container assembly in which four by four-stage constant-temperature transport containers are loaded will be described as a configuration example of a constant-temperature transport container assembly in which constant-temperature transport containers are loaded in large quantity. FIGS. 12 to 14 illustrate longitudinal cross sections each obtained by cutting the constant-temperature transport container assembly in the vertical direction.

In a constant-temperature transport container assembly 100D illustrated in FIG. 12, the four by four-stage constant-temperature transport containers have a first wall part in which the stored material T (heat storage material P) is housed in the housing part and a second wall part in which the stored material T1 (heat insulating material I1) is housed in the housing part. In the four by four-stage constant-temperature transport containers, the first wall part is assigned to two wall parts adjacent to each other. On the other hand, in the four by four-stage constant-temperature transport containers, the second wall part is assigned to a wall part which is not adjacent to any wall part. It can be said that the wall part to which the second wall part is assigned is a wall part exposed to the outside of the constant-temperature transport container assembly 100D.

In the constant-temperature transport container assembly 100D illustrated in FIG. 12, for example, the first wall part in which the stored material T is housed is assigned to a short-side surface part 11B and a short-side surface part 13A which are adjacent to each other. Further, for example, the second wall part in which the stored material T1 is housed is assigned to the short-side surface part 11A, a top surface part 15A, and a bottom surface part 16B which are exposed to the outside.

A constant-temperature transport container assembly 100E illustrated in FIG. 13, like the constant-temperature transport container assembly 100D illustrated in FIG. 12, has the first wall part and the second wall part. However, the constant-temperature transport container assembly 100E differs from the constant-temperature transport container assembly 100D in positional relationship between the first wall part and the second wall part in the four by four-stage constant-temperature transport containers.

First, in four by four-stage constant-temperature transport containers, the first wall part is assigned to two wall parts that are adjacent to each other in the horizontal direction. In addition, in the four by four-stage constant-temperature transport containers, the second wall part is assigned to a wall part which is not adjacent to any wall part. In addition, in the four by four-stage constant-temperature transport containers, the first wall part and the second wall part are assigned to two wall parts that are adjacent to each other in the vertical direction. In the two wall parts adjacent to each other in the vertical direction, the second wall part is assigned to the upper wall part, and the first wall part is assigned to the lower wall part.

In the constant-temperature transport container assembly 100E illustrated in FIG. 13, for example, the first wall part in which the stored material T is housed is assigned to the short-side surface part 11D and the short-side surface part 13C which are adjacent to each other in the horizontal direction. Further, for example, the second wall part in which the stored material T1 is housed is assigned to the short-side surface part 11C, the top surface part 15C, and the bottom surface part 16D which are exposed to the outside. Further, for example, the first wall part and the second wall part are assigned to the bottom surface part 16C and the top surface part 15D which are adjacent to each other in the vertical direction. In the bottom surface part 16C and the top surface part 15D, the second wall part is assigned to the bottom surface part 16C which is disposed on the upper side, and the first wall part is assigned to the top surface part 15D which is disposed on the lower side. In the constant-temperature transport container assembly illustrated in FIG. 13, when the heat insulating container X1 has been connected to another heat insulating container X2, the housing part 16*a* of the bottom surface part 16C of the constant-temperature transport container 10P is located in a connection part B. The housing part 16*a* is configured so as to be a heat insulating part for covering the stored material T (heat storage material P) to be housed in the housing part 15*a* of the top surface part of the another heat insulating container X2. More specifically, the housing part 16*a* of the bottom surface part 16C of the constant-temperature transport container 10P has a configuration in which the stored material T1 (heat insulating material I1) is housed. In this configuration, the heat insulating material I1 covers the stored material T (heat storage material P) that is housed in the housing part 15*a* of the top surface part 15D of the another heat insulating container X2. Note that the configuration illustrated in FIG. 13 can be applied to a case where the time for maintaining the heat storage material P in the constant temperature state (2) in FIG. 7 may be shorter than the time in the configuration illustrated in FIG. 12. In general, the weight of the heat storage material P is greater than the weight of the heat insulating material I. Therefore, the configuration illustrated in FIG. 13 can reduce the weight of the constant-temperature transport container as compared with the configuration illustrated in FIG. 12.

A constant-temperature transport container assembly 100F illustrated in FIG. 14 is configured such that two luggage areas Y and Z are assigned. In the four by four-stage constant-temperature transport containers, the upper two-stage part corresponds to the luggage area Y, and the lower two-stage part corresponds to the luggage area Z. The stored material T8 which is the heat storage material P2 is housed in the constant-temperature transport container belonging to the luggage area Y. On the other hand, the stored material T9 which is the heat storage material P1 is housed in the constant-temperature transport container belonging to the luggage area Z. The heat storage materials P1 and P2 have melting temperature ranges which are different from each other. Note that, in a case where the cost is added in units of constant-temperature transport containers by means of transport (for example, air shipment) of the constant-temperature transport containers, the configuration illustrated in FIG. 14 enables transport of two types of temperature-keeping target articles per unit volume, so that the cost can be reduced.

In the constant-temperature transport container assembly 100F illustrated in FIG. 14, four by four-stage constant-temperature transport containers have a second wall part in which the stored material T1 (heat insulating material I1) is housed in the housing part, a third wall part in which the stored material T8 (heat storage material P2) is housed in the housing part, and a fourth wall part in which the stored material T9 (heat storage material P1) is housed in the housing part. In the four by four-stage constant-temperature transport containers, the second wall part is assigned to a wall part which is not adjacent to any wall part.

In addition, the second wall part and the fourth wall part are assigned to two wall parts which are adjacent to each other across the boundary between the luggage area Y and the luggage area Z. In the two wall parts adjacent to each other across the boundary between the luggage area Y and the luggage area Z, the second wall part is assigned to the wall part belonging to the luggage area Y side, and the fourth wall part is assigned to the wall part belonging to the luggage area Z side.

In addition, in four by two-stage constant-temperature transport containers belonging to the luggage area Y, the third wall part is assigned to two wall parts adjacent to each other. In the four by two-stage constant-temperature transport containers belonging to the luggage area Z, the fourth wall part is assigned to two wall parts which are adjacent to each other.

In the constant-temperature transport container assembly 100F illustrated in FIG. 14, for example, the second wall part in which the stored material T1 is housed is assigned to the short-side surface part 11E, the top surface part 15E, and the bottom surface part 16G which are exposed to the outside. Further, for example, in four by two-stage constant-temperature transport containers belonging to the luggage area Y, the third wall part in which the stored material T8 is housed is assigned to the short-side surface part 11F and the short-side surface part 13E which are two short-side surface parts adjacent to each other. Further, for example, in four by two-stage constant-temperature transport containers belonging to the luggage area Z, the fourth wall part in which the stored material T9 is housed is assigned to the short-side surface part 11G and the short-side surface part 13F which are two short-side surface parts adjacent to each other.

Furthermore, for example, the second wall part and the fourth wall part are assigned to the top surface part 15H and the bottom surface part 16H which are adjacent to each other across the boundary between the luggage area Y and the luggage area Z. In the top surface part 15H and the bottom surface part 16H, the second wall part is assigned to the bottom surface part 16H belonging to the luggage area Y side, and the fourth wall part is assigned to the top surface part belonging to the luggage area Z side.

In the above description, a configuration of the constant-temperature transport container assembly in a longitudinal cross section obtained by cutting the constant-temperature transport container assembly in the vertical direction has been described. However, the constant-temperature transport container assembly in accordance with one or more embodiments may have a configuration similar to those in FIGS. 10 to 14 in a transverse cross section obtained by cutting in the horizontal direction.

Technical Idea of Embodiments 2 to 7

Conventionally, in a case where a temperature-keeping target article which is an object to be transported is packed in a constant-temperature transport package, the temperature-keeping target article is stored in a constant-temperature storage until immediately before the packing. Further, the heat storage material is in a state of being subjected to temperature adjustment in advance. Therefore, employed as a method of packing in the constant-temperature transport package is a method in which the temperature-keeping target article and the heat storage material are brought into a packing work place, and the constant-temperature transport package is assembled in the packing work place. In a case where the constant-temperature transport containers described in Patent Literatures 1 and 2 are used in such a packing method, many operational steps are required for the completion of the constant-temperature transport package, including the operation of mounting the temperature-keeping target article into the constant-temperature transport container, the operation of packing the heat storage material, and the operation of packaging the constant-temperature transport container with an outer packaging material. As a result, the packing in the constant-temperature transport package takes time and effort.

The inventors of one or more embodiments of the present invention have intensively studied simplifying the packing in the constant-temperature transport package. As a result, the inventors of one or more embodiments of the present invention have accomplished a constant-temperature transport container of one or more embodiments by conceiving that the configuration which allows a user to pack a heat storage material from an outer wall surface side of a container body of a constant-temperature transport container greatly reduces the time and effort required for packing in the constant-temperature transport package.

Embodiment 2

The following will describe one or more embodiments of the present invention in detail. FIG. 15 is a perspective view schematically illustrating a configuration of a constant-temperature transport container 10-1 in accordance with one or more embodiments.

The constant-temperature transport container 10-1 in accordance with one or more embodiments has an assembly-type configuration that enables constant-temperature transport of a temperature-keeping target article. As illustrated in FIG. 15, the constant-temperature transport container 10-1 includes a heat insulating container X-1 and a heat storage material P. The heat insulating container X-1 is in the shape of a cuboid box and includes four side wall panels 11-1, a ceiling panel 12-1, a bottom panel 13-1, and a fitting part 14-1.

The side wall panels 11-1 constitute the short-side surface parts or the long-side surface parts. Further, the ceiling panel 12-1 constitutes the top surface part. Further, the bottom panel 13-1 constitutes the bottom surface part. Note that the heat insulating container X-1 of the constant-temperature transport container 10-1 is not limited to an assembly type container including four side wall panels 11-1, a ceiling panel 12-1, and a bottom panel 13-1. The heat insulating container X-1 may be an integral type container in which the short-side surface parts, the long-side surface parts, the top surface part, and the bottom surface part are not constituted by panels. However, from the viewpoint of using in the form of a single unit described in (2) above, it is preferable that the heat insulating container X-1 is an assembly type in which the panels can be separated from each other to achieve space saving. In addition, the size of the heat insulating container X-1 is not particularly limited, but from the viewpoint of using in the form of a single unit described in (2) above, it is preferable that the heat insulating container X-1 has a large size that is difficult for a user to carry by hand, rather than having a hand-held size.

The ceiling panel 12-1 and the bottom panel 13-1 are formed of a rectangular plate material that can be separated from the four side wall panels 11-1. Further, the four side wall panels 11-1 are formed of respective rectangular plate materials. The rectangular plate materials respectively constituting the side wall panels 11-1 can be separated from each other. Here, regarding the side wall panels 11-1, the ceiling panel 12-1, and the bottom panel 13-1, a luggage side of the constant-temperature transport container 10-1 is referred to as an inner side, and a side opposite to the inner side is referred to as an outer side. Further, in the constant-temperature transport container 10-1, a ceiling panel 12-1 side is referred to as an upper side, and a bottom panel 13-1 side is referred to as a lower side.

The four side wall panels 11-1 are connected to the ceiling panel 12-1 and the bottom panel 13-1 by a known connection means. For example, the side wall panels 11-1 are connected to the ceiling panel 12-1 and the bottom panel 13-1 by a projection-and-recess structure. In this case, the projection-and-recess fitting structure is formed between (i) respective upper end portions of the four side wall panels 11-1 and (ii) portions of the ceiling panel 12-1 which portions face the upper end portions. Further, respective lower end portions of the four side wall panels 11-1 are structured to be fitted to the bottom panel 13-1.

Further, the four side wall panels 11-1 are connected to each other by a known connection means. For example, the four side wall panels 11-1 are connected to each other by a projection-and-recess structure. In this case, the rectangular plate materials respectively constituting the four side wall panels 11-1 have the projection-and-recess fitting structure formed in portions of adjacent ones of the rectangular plate materials which portions face the adjacent ones of the rectangular plate materials.

As illustrated in FIG. 15, in the constant-temperature transport container 10-1, one of the four side wall panels 11-1 has a housing part 11-1*a* for housing the heat storage material P. The housing part 11-1*a* is a recess extending in an up-down direction. Note that, in the constant-temperature transport container 10-1 in accordance with one or more embodiments, the number of side wall panels 11-1 in which the housing part 11-1*a* is provided is not limited to one. It is only required that at least one of the four side wall panels 11-1 has the housing part 11-1*a*. Further, in the constant-temperature transport container 10-1, one or more housing parts 11-1*a* are provided in one surface of the side wall panels 11-1. Note that the constant-temperature transport container may have a configuration in which one housing part 11-1*a* is provided in one side wall panel 11-1. However, from the viewpoint of disposing the heat storage material P in a well-balanced manner, a plurality of housing parts 11-1*a* may be provided in one surface of the side wall panels 11-1.

Three heat storage materials P are housed in the housing part 11-1*a*. These three heat storage materials P may be configured to be connected to each other or may be configured to be separated from each other. The housing part 11-1*a* is provided in an outer surface, that is, an outer wall surface, of the side wall panel 11-1. The housing part 11-1*a* has an opening that is open to the outside. Through the opening, the user can store the heat storage material P from the outside of the heat insulating container X-1 into the housing part 11-1*a*.

The fitting part 14-1 is a member that closes the opening of the housing part 11-1*a* that is open to the outside. In the configuration illustrated in FIG. 15, the housing part 11-1*a* is closed by two fitting parts 14-1 aligned in an up-down direction. The fitting parts 14-1 are fitted into the housing part 11-1*a* by a fit. In addition, the fitting parts 14-1 are fitted into the housing part 11-1*a* by a fit so as to be flush with the outer wall surface of the side wall panel 11-1. Since the fitting parts 14-1 are fitted into the housing part 11-1*a* in this manner, it is possible to prevent external air from flowing into the housing part 11-1*a*.

Further, each fitting part 14-1 is provided with a cutout part 14-1*a*. The cutout part 14-1*a* is provided in an outer surface of the fitting part 14-1. The cutout part 14-1*a* functions as a well for hooking a finger(s) when the user moves the fitting part 14-1. Therefore, the size of the cutout part 14-1*a* only need be a size that allows the finger(s) of the user to be hooked. The cutout part 14-1*a* provided in this manner makes it easy for the user to attach or detach the fitting part 14-1 to or from the housing part 11-1*a*.

The cutout part 14-1*a* does not penetrate into the housing part 11-1*a*. The cutout part 14-1*a* is formed as a recessed groove that is open to the outside and extends in a horizontal direction. That is, the cutout part 14-1*a* does not communicate the housing space of the heat storage material P in the housing part 11-1*a* with the outside. Therefore, latent heat of the heat storage material P in the housing part 11-1*a* does not leak to the outside via the fitting part 14-1.

Further, the housing part 11-1*a* and the luggage A may be in communication with each other or may not be in communication with each other as long as the heat storage material P can maintain the temperature-keeping target article in the luggage A at a constant temperature. The housing part 11-1*a* and the luggage A may be in communication with each other.

Note that FIG. 15 and the following perspective views illustrating the constant-temperature transport container illustrate that the heat storage material P and the fitting part 14-1 are provided in one of the three housing parts 11-1*a*. In these drawings, the heat storage material P and the fitting part 14-1 provided in the remaining two housing parts 11-1*a* are omitted.

The housing part 11-1*a* is not limited to the configuration illustrated in FIG. 15 as long as the heat storage material P can be housed in the housing part 11-1*a*. Further, the number of housing parts 11-1*a* and the size thereof can be set as appropriate according to the structure of the heat insulating container X-1 of the constant-temperature transport container 10-1 and the configuration of the heat storage material P.

Further, the constant-temperature transport container may have a configuration in which a heat storage material P, a housing part 12-1*a* for housing the heat storage material P, and a fitting part (not illustrated) that is fitted into the housing part 12-1*a* by a fit are provided in the ceiling panel 12-1. This configuration is effective when the heat storage material P is set in the ceiling panel 12-1 in addition to the side wall panel 11-1.

Next, a method of carrying out packing in a constant-temperature transport package using the constant-temperature transport container 10-1 will be described. For example, the packing method is performed by the following steps (1) to (4).

(1) The four side wall panels 11-1, the ceiling panel 12-1, the bottom panel 13-1, and the temperature-keeping target article are prepared, and the heat insulating container X-1 in which the temperature-keeping target article is mounted is assembled. (2) From the outside, the heat storage material P is housed in the housing part 11-1*a* of the side wall panel

11-1 (if necessary, the housing part 12-1*a* of the ceiling panel 12-1) in the assembled heat insulating container X-1. (3) The fitting part 14-1 is fitted, by a fit, into the housing part 11-1*a* in which the heat storage material P is housed. (4) The heat insulating container X-1 into which the fitting part 14-1 has been fitted is packaged with an outer packaging material. The constant-temperature transport package of the constant-temperature transport container 10-1 is completed by the steps (1) to (4).

As described above, in the method of carrying out packing in the constant-temperature transport package using the constant-temperature transport container 10-1, the heat storage material P can be mounted from the outer wall surface of the heat insulating container X-1. Therefore, the setting of the heat storage material P with respect to the side wall panel 11-1 is simplified. Therefore, according to the configuration of the constant-temperature transport container 10-1, time and effort required for carrying out packing in the constant-temperature transport package is greatly reduced.

Further, the packing method enables the following. That is, only the operation of mounting the temperature-keeping target article in the heat insulating container X-1 is performed in advance, and only the operation of setting the heat storage material P with respect to the side wall panel 11-1 is performed on the day of packing in the constant-temperature transport package. Therefore, it is possible to reduce the effort of the operation to be performed on the day of packing in the constant-temperature transport package. Note that the operation of mounting the temperature-keeping target article in the heat insulating container X-1 may be performed on the day before the packing in the constant-temperature transport package.

1601 of FIG. 16A is a cross-sectional view illustrating an example of a configuration of the side wall panel 11-1. In the configuration illustrated in 1601 of FIG. 16A, the heat storage material P may be structured to have a projection Pa that protrudes toward the luggage A side. In addition, the housing part 11-1*a* has a hole part 11-1*b* that communicates with the luggage A. The hole part 11-1*b* is structured so as to be fitted to the luggage A-side shape of the heat storage material P. More specifically, the hole part 11-1*b* has a shape that is fitted to the projection Pa of the heat storage material P. By the fitting between the hole part 11-1*b* and the projection Pa, the heat storage material P is less likely to move in the housing part 11-1*a*, and the position of the heat storage material P is fixed. Cool air from the heat storage material P housed in the housing part 11-1*a* flows into the luggage A via the hole part 11-1*b*. Note that, as illustrated in 1602 of FIG. 16B, the heat storage material P may be in the shape of a rectangular parallelepiped without the projection Pa.

FIG. 17 is a plan view schematically illustrating a configuration of Variation 1 of the constant-temperature transport container 10-1. A constant-temperature transport container 10'-1 as Variation 1 differs from the configuration illustrated in FIG. 15 in that the luggage A inside a heat insulating container X'-1 further includes a heat storage material P0. Even with such a configuration, the time and effect required for carrying out packing in the constant-temperature transport package are greatly reduced.

As a material of the fitting part 14-1, the material of the heat insulating container X described in Embodiment 1 can be employed.

Further, in one or more embodiments, a plurality of heat storage materials having different melting temperature ranges may be used. Two or more kinds of heat storage material(s) and/or cold storage material(s) having different solidified/melted states can be placed and stored in the constant-temperature transport containers 10-1 and 10'-1 in accordance with one or more embodiments.

FIG. 18 illustrates a configuration in a case where the two or more kinds of the heat storage material(s) and/or the cold storage material(s) having different solidified/melted states are used. As a specific example shown based on the configuration illustrated in FIG. 18, a heat storage material or a cold storage material whose melting temperature is adjusted to around 5° C. or 20° C. corresponds to the heat storage material P1, and a heat storage material or a cold storage material whose melting temperature is adjusted to 0° C. corresponds to the heat storage material P2.

From the viewpoint of versatility of the heat storage material and/or the cold storage material, the heat storage material P is a connected body including a plurality of heat storage materials and/or cold storage materials that are connected to each other. This makes it possible to improve the workability of packing the heat storage material P and to provide the heat storage material P suitable for multiple constant-temperature transport containers having different sizes. As a result, the versatility of the heat storage material P is enhanced.

Embodiment 3

The following will describe one or more embodiments of the present invention. For convenience, members having identical functions to those of the foregoing embodiments are given identical reference signs, and their descriptions will be omitted.

FIG. 19 is a perspective view schematically illustrating a configuration of a constant-temperature transport container in accordance with one or more embodiments. As illustrated in FIG. 19, the constant-temperature transport container 10-1A in accordance with one or more embodiments differs from Embodiment 2 in a configuration of a fitting part 15-1.

The constant-temperature transport container 10-1A has a configuration in which the housing part 11-1*a* is closed by one fitting part 15-1. Further, a cutout part 15-1*a* has a configuration in which two sets of two dot-like recesses aligned in a horizontal direction are aligned in an up-down direction. The size of each dot-like recess is set so that a finger of the user can be inserted therein.

Even with the constant-temperature transport container in accordance with one or more embodiments, it is possible to greatly reduce the time and effect required for carrying out packing in the constant-temperature transport package.

Embodiment 4

The following will describe one or more embodiments of the present invention. For convenience, members having identical functions to those of the foregoing embodiments are given identical reference signs, and their descriptions will be omitted.

FIG. 20 is a perspective view schematically illustrating a configuration of a constant-temperature transport container in accordance with one or more embodiments. As illustrated in FIG. 20, the constant-temperature transport container 10-1B in accordance with one or more embodiments differs from Embodiment 2 in a configuration of a fitting part 16-1A.

The constant-temperature transport container 10-1B has a configuration in which the housing part 11-1*a* is closed by one fitting part 16-1A. Two cutout parts 16-1*a* and 16-1*b* aligned in an up-down direction are formed in the fitting part

16-1A. The cutout part 16-1*a* is a recessed groove that is recessed from the outer surface of the fitting part 16-1A toward the luggage-A side and is recessed downward in the middle. Further, the cutout part 16-1*b* is a recessed groove which is recessed from the outer surface of the fitting part 16-1A toward the luggage-A side and recessed upward in the middle. By inserting both hands into the cutout parts 16-1*a* and 16-1*b*, the user can easily grasp the fitting part 16-1A with both hands.

Even with the constant-temperature transport container in accordance with one or more embodiments, it is possible to greatly reduce the time and effect required for carrying out packing in the constant-temperature transport package.

Embodiment 5

The following will describe yet one or more embodiments of the present invention. For convenience, members having identical functions to those of the foregoing embodiments are given identical reference signs, and their descriptions will be omitted.

2101 of FIG. 21A is a perspective view schematically illustrating a configuration of a constant-temperature transport container 10-1C in accordance with one or more embodiments. 2102 of FIG. 21B is a cross-sectional view illustrating a configuration of a side wall panel 11-1 of the constant-temperature transport container 10-1C. As illustrated in 2101 and 2102 of FIGS. 21A-B, the constant-temperature transport container 10-1C in accordance with one or more embodiments differs from Embodiment 2 in a configuration of a fitting part 16-1B. Further, the fitting structure of the fitting part 16-1B with respect to the housing part 11-1*a* differs from that of the fitting part 16-1A in Embodiment 4.

The fitting part 16-1B has two fitting projections 16-1*c* that are provided on the luggage-A side surface and that are for being fitted into the housing part 11-1*a*. Each of the fitting projections 16-1*c* is a long projection that extends in an up-down direction. The housing part 11-1*a* has a recess 11-1*c* provided on the side opposite to the luggage A with respect to the hole part 11-1*b*. The heat storage material P is disposed in the recess 11-1*c*. In a state of being disposed in the recess 11-1*c*, the heat storage material P is spaced from the side walls of the housing part 11-1*a*. The two fitting projections 16-1*c* are disposed so as to correspond to parts where the heat storage material P is spaced from the side walls of the housing part 11-1*a*. Further, a recess 11-1*d* formed by the side walls of the housing part 11-1*a* and the heat storage material P is fitted to the fitting projections 16-1*c*. By such a fit, the fitting part 16-1B closes the housing part 11-1*a* more firmly. Therefore, it is possible to prevent external air from flowing into the housing part 11-1*a* (the housing space of the heat storage material P). In the configuration illustrated in FIGS. 21A-B, the recess into which the fitting projections 16-1*c* are fitted is formed by the side walls of the housing part 11-1*a* and the heat storage material P. However, such a fitting recess may be formed in any form with respect to the housing part 11-1*a* as long as the fitting recess can be fitted to the fitting projections 16-1*c*. For example, a configuration may be adopted in which a recessed groove is formed as the fitting recess in the housing part 11-1*a* at a position abutting on the fitting projections 16-1*c*. In this configuration, independently of the heat storage material P (even in a state in which the heat storage material P is not housed in the housing part 11-1*a*), the fitting projections 16-1*c* are fitted into the recessed groove.

Embodiment 6

The following will describe further one or more embodiments of the present invention. For convenience, members having identical functions to those of the foregoing embodiments are given identical reference signs, and their descriptions will be omitted.

FIG. 22 is a perspective view schematically illustrating a configuration of a constant-temperature transport container in accordance with one or more embodiments. As illustrated in FIG. 22, the constant-temperature transport container 10-1D in accordance with one or more embodiments differs from Embodiment 2 in that a fitting part 17-1 includes a recessed groove 17-1*c* (mounting part) in which the heat storage material P is mounted.

The fitting part 17-1 has cutout parts 17-1*a* and 17-1*b*, a recessed groove 17-1*c*, and two locking parts 17-1*d*.

The cutout parts 17-1*a* and 17-1*b* are formed so as to be aligned in an up-down direction. The cutout part 17-1*a* is a recessed groove that is recessed from the outer surface of the fitting part 17-1 toward the luggage-A side and recessed downward in the middle. Further, the cutout part 17-1*b* is a recessed groove which is recessed from the outer surface of the fitting part 17-1 toward the luggage-A side and recessed upward in the middle. By inserting both hands into the cutout parts 17-1*a* and 17-1*b*, the user can easily grasp the fitting part 17-1 with both hands.

The recessed groove 17-1*c* is a recessed groove that is open to the inside, and extends in the up-down direction. The recessed groove 17-1*c* allows three heat storage materials P to be housed therein, and the heat storage material P is configured so as to be slidable in the up-down direction.

The two locking parts 17-1*d* are long projections that protrude from the inner end parts of the side walls of the recessed groove 17-1*c* so as to narrow the width of the recessed groove 17-1*c*. Each of the two locking parts 17-1*d* is a long projection extending in the up-down direction. In a state in which the heat storage material P is housed in the recessed groove 17-1*c*, the locking parts 17-1*d* abut on the inner surface of the heat storage material P. The locking parts 17-1*d* have a function of locking the heat storage material P housed in the recessed groove 17-1*c* from moving toward the housing part 11-1*a*. By the recessed groove 17-1*c* and the locking parts 17-1*d*, the heat storage material P is mounted in the fitting part 17-1 so as to be integrally movable. In addition, the two locking parts 17-1*d* constitute an opening that communicates a space in the recessed groove 17-1*c* with a space in the housing part 11-1*a*.

Further, the method of carrying out packing in the constant-temperature transport package using the constant-temperature transport container 10-1D in accordance with one or more embodiments differs from Embodiment 2 in the steps for housing the heat storage material P in the housing part 11-1*a* of the side wall panel 11-1 from the outside. More specifically, in the method of carrying out packing in the constant-temperature transport package using the constant-temperature transport container 10-1 in accordance with Embodiment 2 described above, the steps (2) and (3) are different.

In the method of carrying out packing in the constant-temperature transport package using the constant-temperature transport container 10-1D, the following steps (i) and (ii) are performed when the heat storage material P is housed in the housing part 11-1*a* of the side wall panel 11-1 from the outside. (i) The heat storage material P is mounted in the fitting part 17-1 by inserting three heat storage materials P into the recessed groove 17-1*c* of the fitting part 17-1. (ii) The fitting part 17-1 in which the heat storage material P is mounted is fitted into the housing part 11-1*a* of the side wall panel 11-1 (if necessary, the housing part 12-1*a* of the ceiling panel 12-1) in the constant-temperature transport container 10-1D by a fit from the outside.

In the method of carrying out packing in the constant-temperature transport package using the constant-temperature transport container 10-1D, the heat storage material P is fitted into the housing part 11-1*a* in a state of being integrated with the fitting part 17-1. That is, instead of housing the heat storage material P alone in the housing part 11-1*a*, the heat storage material P is mounted in advance in the fitting part 17-1 and then fitted into the housing part 11-1*a*. This, as compared with the case where the heat storage material P alone is housed in the housing part 11-1*a*, can eliminate the inconvenience that, when the fitting part 17-1 is fitted into the housing part 11-1*a*, the heat storage material P is not easily fitted into the housing part 11-1*a* because the heat storage material P leans toward the fitting part 17-1.

Embodiment 7

The following will describe one or more embodiments of the present invention. For convenience, members having identical functions to those of the foregoing embodiments are given identical reference signs, and their descriptions will be omitted.

FIG. 23 is a perspective view schematically illustrating a configuration of a constant-temperature transport container in accordance with one or more embodiments. As illustrated in FIG. 23, the constant-temperature transport container 10-1E in accordance with one or more embodiments differs from Embodiment 2 in that the housing part 11-1*a* is a recess extending in a horizontal direction.

As illustrated in FIG. 23, three housing parts 11-1*a* are disposed so as to be aligned in an up-down direction. A plurality of heat storage materials P are housed in each housing part 11-1*a* so as to be aligned in the horizontal direction.

A fitting part 18-1 is a member that closes an opening that is open to the outside in the housing part 11-1*a*. Thus, the fitting part 18-1 in the shape of a rectangular parallelepiped that extends in the horizontal direction.

The fitting part 18-1 is provided with a cutout part 18-1*a*. The cutout part 18-1*a* is provided in an outer surface of the fitting part 18-1. The cutout part 18-1*a* functions as a well for hooking a finger(s) when the user moves the fitting part 18-1.

Even with the constant-temperature transport container 10-1E in accordance with one or more embodiments, it is possible to greatly reduce the time and effect required for carrying out packing in the constant-temperature transport package.

One or more embodiments of the present invention are not limited to the embodiments, but can be altered by a skilled person in the art within the scope of the claims. One or more embodiments of the present invention also encompass, in its technical scope, any embodiments derived by combining technical means disclosed in differing embodiments.

Aspects of one or more embodiments of the present invention can also be expressed as follows:

A constant-temperature transport container 10 in accordance with Aspect 1 of one or more embodiments of the present invention is configured to be a constant-temperature transport container 10 including: a heat insulating container X; and a heat storage material P, the heat insulating container X having a luggage A formed therein and being in a shape of a cuboid box, the heat insulating container X having side surface parts (short-side surface parts 11, 13; long-side surface parts 12, 14), a top surface part 15, and a bottom surface part 16, the constant-temperature transport container including a housing part 11*a* to 14*a*, 16*a* that is provided on an outer side of the heat insulating container X and that is for housing the heat storage material P in at least one surface selected from the group consisting of the side surface parts and the bottom surface part 16. Further, a constant-temperature transport container 10-1 in accordance with Aspect 1 of one or more embodiments of the present invention is configured to be a constant-temperature transport container 10-1 including: a heat insulating container X-1; and a heat storage material P, the heat insulating container X-1 having a luggage A formed therein and being in a shape of a cuboid box, the heat insulating container X-1 having side surface parts (side wall panels 11-1), a top surface part 15 (ceiling panel 12-1), and a bottom surface part (bottom panel 13-1), the constant-temperature transport container 10-1 including a housing part 11-1*a* that is provided on an outer side of the heat insulating container X-1 and that is for housing the heat storage material P in at least one surface selected from the group consisting of the side surface parts and the bottom surface part.

The constant-temperature transport container 10 in accordance with Aspect 2 of one or more embodiments of the present invention is configured, in Aspect 1, such that the heat insulating container X has a fitting recess-and-projection part (long projection 10*a*, recessed groove 10*b*, long projection 10*c*) which is formed on at least one surface selected from the group consisting of the side surface parts, the top surface part and the bottom surface part 16 so as to enable connection with another heat insulating container X.

The constant-temperature transport container 10 in accordance with Aspect 3 of one or more embodiments of the present invention is configured, in Aspect 2, such that, when the heat insulating container X1 has been connected to the another heat insulating container X2, the housing part 16*a* is located in a part B where the connection is provided between the heat insulating container X1 and the another heat insulating container X2, and the another heat insulating container X2 is configured so as to be a heat insulating part for covering the heat storage material P housed in the housing part 15*a*.

The constant-temperature transport container 10 in accordance with Aspect 4 of one or more embodiments of the present invention is configured, in any of Aspects 1 to 3, such that a plurality of heat storage materials P1, P2 having different melting temperature ranges are housed in the housing part 11*a* to 16*a*.

The constant-temperature transport container 10 in accordance with Aspect 5 of one or more embodiments of the present invention is configured, in any of Aspects 1 to 4, such that the housing part 11*a* has a recess 11*b* that is fitted to a luggage A-side shape of one heat storage material P or a collective body of a plurality of heat storage materials P1 and P2.

The constant-temperature transport container 10 in accordance with Aspect 6 of one or more embodiments of the present invention is configured, in Aspect 5, to include a first fitting part (stored material T, stored materials T1 to T7) that is fitted into the recess 11*b* so as to be flush with at least an outer surface of the heat insulating container X in which the housing part 11*a* is provided and that is constituted by at least one member selected from the group consisting of the one heat storage material P, the plurality of heat storage materials P1 and P2, and a heat insulating material I1.

The constant-temperature transport container 10 in accordance with Aspect 7 of one or more embodiments of the present invention is configured, in any of Aspects 1 to 6, to further include a heat storage material (stored material T0) in the luggage A inside the heat insulating container X.

The constant-temperature transport container 10-1 in accordance with Aspect 8 of one or more embodiments of the present invention is configured, in Aspect 1, such that the housing part 11-1*a* is formed in any of the side surface parts (side wall panels 11-1), and the constant-temperature transport container 10-1 includes a second fitting part (fitting part 14-1) that is fitted into the housing part 11-1*a* by a fit, the second fitting part having a cutout part 14-1*a* formed therein.

The constant-temperature transport container 10-1 in accordance with Aspect 9 of one or more embodiments of the present invention is configured, in Aspect 8, such that the heat insulating container X-1 is an assembly type container that includes four side wall panels 11 which serve as the side surface parts, a ceiling panel 12-1 which serves as the top surface part, and a bottom panel 13-1 which serves as the bottom surface part.

The constant-temperature transport container 10-1 in accordance with Aspect 10 of one or more embodiments of the present invention is configured, in Aspect 9, such that the housing part 11-1*a* includes a plurality of housing parts 11-1*a* which are provided in each one of the side wall panels 11-1.

The constant-temperature transport container 10-1C in accordance with Aspect 11 of one or more embodiments of the present invention is configured, in any of Aspects 8 to 10, such that the second fitting part (fitting part 16-1B) is provided with a fitting projection 16-1*c* for being fitted into the housing part 11-1*a*, and the housing part 11-1*a* is provided with a fitting recess (recess 11-1*d* formed by side walls of the housing part 11-1*a* and the heat storage material P) into which the fitting projection 16-1*c* is fitted. The constant-temperature transport container 10-1D in accordance with Aspect 12 of one or more embodiments of the present invention is configured, in any of Aspects 8 to 11, such that the second fitting part (fitting part 17-1) includes a mounting part (recessed groove 17-1*c*) in which the heat storage material P is mounted.

A constant-temperature transport container assembly 100 is configured to include: a constant-temperature transport container 10 according to any of Aspects 1 to 7; and a pallet 20 in which the constant-temperature transport container 10 is loaded, wherein a plurality of the constant-temperature transport containers 10 are fitted and connected to each other.

OTHER CONFIGURATIONS

The constant-temperature transport container 10 in accordance with Aspect 14 of one or more embodiments of the present invention is configured, in any of Aspects 1 to 7, to further include the housing part 15*a* that is provided on the outer side of the heat insulating container X and that is provided in the top surface part 15.

The constant-temperature transport container 10-1 in accordance with Aspect 15 of one or more embodiments of the present invention is configured to be an assembly type constant-temperature transport container 10-1 enabling constant-temperature transport of a temperature-keeping target article and including four side wall panels 11-1, a ceiling panel 12-1, and a bottom panel 13-1, wherein at least one of the four side wall panels 11-1 includes: a housing part 11-1*a* that is provided on an outer wall surface and that is for housing the heat storage material P; and a fitting part 14-1 that is fitted into the housing part 11-1*a* by a fit, the fitting part 14-1 having a cutout part 14-1*a* formed therein.

The constant-temperature transport container 10-1 in accordance with Aspect 16 of one or more embodiments of the present invention is configured, in any of Aspects 8 to 12 or Aspect 15, such that the housing part 12-1*a* and the second fitting part are provided in the ceiling panel 12-1.

The constant-temperature transport container 10-1 in accordance with Aspect 17 of one or more embodiments of the present invention is configured, in any of Aspects 8 to 12 or Aspect 15 or 16, such that the cutout part 14-1*a* does not penetrate into the housing part 11-1*a*.

REFERENCE SIGNS LIST

10, 10A to 10M: constant-temperature transport container
10*a*, 10*c*: long projection (projection-and-recess fitting part) recessed groove (projection-and-recess fitting part)
11, 11A to 11G: short-side surface part (side surface part)
11*a*: housing part
11*b*: recess
12: short-side surface part (side surface part)
12*a*: housing part
12*b*: recess
13, 13A, 13C, 13E, 13F: short-side surface part (side surface part)
13*a*: housing part
13*b*: recess
14: long-side surface part (side surface part)
14*a*: housing part
14*b*: recess
15A, 15C, 15D, 15E, 15H: top surface part housing part
16, 16B, 16C, 16D, 16G, 16H: bottom surface part
16*a*: housing part
20: pallet
100, 100A to 100F: constant-temperature transport container assembly
A: luggage
I1 to I6: heat insulating material
P, P0 to P9: heat storage material
T1 to T10: stored material (first fitting part)
X, X1, X2: heat insulating container
10'-1, 10-1A: constant-temperature transport container
10-1C, 10-1D: constant-temperature transport container
11-1: side wall panel
11-1*a*, 12-1*a*: housing part
11-1*b*: hole part
12-1: ceiling panel
13-1: bottom panel
14-1, 15-1, 16-1A: fitting part (second fitting part)
16-1B, 17-1: fitting part (second fitting part)
14-1*a*, 15-1*a*, 16-1*a*: cutout part
16-1*b*, 17-1*a*, 17-1*b*: cutout part
16-1*c*: fitting projection
17-1*c*: recessed groove (mounting part)
X-1, X'-1: heat insulating container Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

The invention claimed is:

1. A constant-temperature transport container comprising:

a heat insulating container; and a heat storage material, the heat insulating container having a luggage formed therein and being in a shape of a cuboid box, the heat insulating container having side surface parts, a top surface part, and a bottom surface part, and the constant-temperature transport container comprising a housing part that is provided on an outer side of the heat insulating container for housing the heat storage material in at least one surface selected from the group consisting of the side surface parts and the bottom surface part.

2. The constant-temperature transport container according to claim 1, wherein the heat insulating container has a fitting recess-and-projection part which is formed on at least one surface selected from the group consisting of the side surface parts, the top surface part, and the bottom surface part so as to enable connection with another heat insulating container.

3. The constant-temperature transport container according to claim 2, wherein when the heat insulating container is connected to the another heat insulating container, the housing part is located in a part where the connection is provided between the heat insulating container and the another heat insulating container, and the another heat insulating container is configured so as to be a heat insulating part for covering the heat storage material housed in the housing part.

4. The constant-temperature transport container according to claim 1, wherein a plurality of heat storage materials having different melting temperature ranges are housed in the housing part.

5. The constant-temperature transport container according to claim 1, wherein the housing part has a recess that is fitted to a shape of a luggage-side of one heat storage material or a collective body of a plurality of heat storage materials.

6. The constant-temperature transport container according to claim 5, comprising a first fitting part that is fitted into the recess so as to be flush with at least an outer surface of the heat insulating container in which the housing part is provided, and that is constituted by at least one member selected from the group consisting of the one heat storage material, the plurality of heat storage materials, and a heat insulating material.

7. The constant-temperature transport container according to claim 1, further comprising a heat storage material in the luggage inside the heat insulating container.

8. The constant-temperature transport container according to claim 1, wherein the housing part is formed in any of the side surface parts, and the constant-temperature transport container comprises a second fitting part that is fitted into the housing part by a fit, the second fitting part having a cutout part formed therein.

9. The constant-temperature transport container according to claim 8, wherein the heat insulating container is an assembly type container that includes four side wall panels which serve as the side surface parts, a ceiling panel which serves as the top surface part, and a bottom panel which serves as the bottom surface part.

10. The constant-temperature transport container according to claim 9, wherein the housing part comprises a plurality of housing parts which are provided in each one of the side wall panels.

11. The constant-temperature transport container according to claim 8, wherein the second fitting part is provided with a fitting projection for being fitted into the housing part, and the housing part is provided with a fitting recess into which the fitting projection is fitted.

12. The constant-temperature transport container according to claim 8, wherein the second fitting part includes a mounting part in which the heat storage material is mounted.

13. A constant-temperature transport container assembly comprising:

a plurality of the constant-temperature transport containers according to claim 1; and a pallet in which the plurality of the constant-temperature transport containers is loaded, wherein the plurality of the constant-temperature transport containers are fitted and connected to each other.

* * * * *